US012703538B2

(12) United States Patent
Kennedy et al.

(10) Patent No.: US 12,703,538 B2
(45) Date of Patent: Aug. 11, 2026

(54) INTERLOCKING BASKET SYSTEM

(71) Applicant: TARGET BRANDS, INC., Minneapolis, MN (US)

(72) Inventors: Amelia Kennedy, Minneapolis, MN (US); Nathan Pennycuick, Melbourne (AU); Fadde Ali, Melbourne (AU)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 19/080,517

(22) Filed: Mar. 14, 2025

(65) Prior Publication Data

US 2025/0206501 A1 Jun. 26, 2025

Related U.S. Application Data

(63) Continuation of application No. 18/235,520, filed on Aug. 18, 2023, now Pat. No. 12,263,991.

(60) Provisional application No. 63/400,550, filed on Aug. 24, 2022.

(51) Int. Cl.

| | |
|---|---|
| ***B65D 21/06*** | (2006.01) |
| ***B65D 1/22*** | (2006.01) |
| ***B65D 25/20*** | (2006.01) |
| *B65D 25/30* | (2006.01) |

(52) U.S. Cl.

CPC ..... *B65D 21/066* (2013.01); *B65D 1/22* (2013.01); *B65D 25/20* (2013.01); *B65D 25/30* (2013.01)

(58) Field of Classification Search

CPC .... B65D 21/06; B65D 21/066; B65D 21/068; B65D 21/0212; B65D 25/20; B65D 25/30; B65D 1/40; D06F 95/002

See application file for complete search history.

(56) References Cited

U.S. PATENT DOCUMENTS

| | | | | |
|---|---|---|---|---|
| 4,519,503 | A | 5/1985 | Wilson | |
| 5,638,973 | A | 6/1997 | Dewey et al. | |
| D380,880 | S | 7/1997 | Reid | |
| 6,062,388 | A * | 5/2000 | Ohayon | B65D 21/0216 206/520 |
| 6,085,932 | A | 7/2000 | Cope | |

(Continued)

FOREIGN PATENT DOCUMENTS

| | | |
|---|---|---|
| CN | 303130764 | 3/2015 |
| WO | 2005097608 A1 | 10/2005 |

OTHER PUBLICATIONS

U.S. Appl. No. 29/838,612, Target Brands, Inc.

(Continued)

*Primary Examiner* — Don M Anderson
(74) *Attorney, Agent, or Firm* — Dorsey & Whitney LLP

(57) ABSTRACT

A storage container includes: a plurality of sidewalls; a bottom wall operably coupled to the plurality of sidewalls, together defining a storage cavity; at least one support bracket coupled to the bottom wall, movable between a first position wherein an outer surface of at least one support bracket is flush with a perimeter of the bottom wall, and a second position wherein the outer surface of the at least one support bracket extends beyond the perimeter; and a plurality of guide walls extending parallel to one another and formed adjacent to the at least one support bracket that guide the movement of the at least one support bracket between the first position and second the position.

20 Claims, 27 Drawing Sheets

(56) References Cited

U.S. PATENT DOCUMENTS

| | | | | |
|---|---|---|---|---|
| D643,584 | S | | 8/2011 | Duvigneau |
| D651,405 | S | | 1/2012 | Lee |
| D689,695 | S | | 9/2013 | Hu |
| D692,666 | S | | 11/2013 | Goodman et al. |
| D697,310 | S | * | 1/2014 | Snider ..... D3/306 |
| D719,733 | S | | 12/2014 | Liu |
| D764,170 | S | | 8/2016 | Bougay et al. |
| D789,089 | S | | 6/2017 | Duvigneau |
| D880,160 | S | * | 4/2020 | Hsu ..... D3/304 |
| D906,767 | S | | 1/2021 | Hollinger |
| D925,912 | S | | 7/2021 | Lu |
| D945,162 | S | | 3/2022 | Kennedy et al. |
| D948,224 | S | * | 4/2022 | Kennedy ..... D5/43 |
| 11,407,561 | B2 | * | 8/2022 | Guindi ..... B65D 21/0215 |
| D974,761 | S | | 1/2023 | Messalem |
| D978,533 | S | | 2/2023 | Dai |
| D1,000,120 | S | | 10/2023 | Hsu |
| D1,011,749 | S | | 1/2024 | Lin |
| D1,024,563 | S | | 4/2024 | Zhang |
| 2003/0183549 | A1 | | 10/2003 | Verna et al. |
| 2004/0060844 | A1 | | 4/2004 | Stahl |
| 2007/0102385 | A1 | * | 5/2007 | Killinger ..... B42F 7/12 211/126.7 |
| 2012/0132558 | A1 | * | 5/2012 | Busch ..... B65D 21/062 206/503 |
| 2021/0253302 | A1 | * | 8/2021 | Guindi ..... B65D 21/0215 |
| 2024/0067398 | A1 | * | 2/2024 | Kennedy ..... B65D 25/20 |

OTHER PUBLICATIONS

U.S. Appl. No. 29/838,613, Target Brands, Inc.
U.S. Appl. No. 29/838,614, Target Brands, Inc.
U.S. Appl. No. 29/931,969, Target Brands, Inc.
Amazon, "3-Pack Plastic Stackable Storage Basket, White Stacking Organizer Basket," Poster online on Amazon.com, first available dated on Jun. 26, 2019, retrieved on Jun. 11, 2024, https://www.amazon.com/Hommp-Stackable-Detachable-Organizer-Stacking/dp/B07S3RSVRH, 4 pages.
Amazon, "QsunQ 3-Set Stackable Storage Bins with Lids for Kitchenend.Bathrooms, Bedrooms, Closets, Cabinets," Household Plastic Organization Baskets for Pantry, Storage Organization Bin Basket (12×11×10 inch), first available date on May 12, 2020, retrieved on Jun. 11, 2024, https://www.amazon.ca/QsunQ-Stackable-Bathrooms-Organization-12×11'10inch/dp/BO88CVZJ3V/, 5 pages.
Amazon, "Starplast Medium Closet Bins 4-Pack: 4 Piece Angled Flexible Plastic Home or Office Accessory Organizer Storage Bins," posted online on amazon.sa, first available dated on Mar. 17, 2022, retrieved on Jun. 11, 2024, https://www.amazon.sa/-/en/Starplast-Medium-Closet-Bins-4-Pack/dp/B09M7H79SV, 3 pages.
Target, "Wave Open Front Bin—Brightroom," posted online target.com, [TinEye Date on Jul. 21, 2022], Retrieved on Jun. 11, 2024, https://www.target.com/p/wve-open-front-bin-brightroom/-/A-84997281?preselect=84734982, 6 pages.
Target Brands, Inc., "Wave Open Front Bin—Brightroom—Black," The Wayback Machine, https://web.archive.org/web/20220727223732/https://www.target.com/p/wave-open-front-bin-brightroom/-/A-84997281, Archived Jul. 2, 2022, 4 pages.
Target Brands, Inc., "Wave Open Front Bin—Brightroom—Black," The Wayback Machine, https://web.archive.org/web/20230606011814/https://www.target.com/p/wave-open-front-bin-black-brightroom-8482/-/A-84734982, Archived Jun. 6, 2023, 8 pages.
Target Brands, Inc., "Wave Open Front Bin—Brightroom—Gray," The Wayback Machine, https://web.archive/org/web/20221031231627/https://www.target.com/p/wave-open-front-bin-gray-brightroom-8482/-/A-84734985, Archived Oct. 31, 2022, 7 pages.
U.S. Appl. No. 18/235,520, filed Aug. 18, 2023.
U.S. Appl. No. 63/400,550, filed Aug. 24, 2022.

* cited by examiner

INTERLOCKING BASKET SYSTEM

CROSS REFERENCE TO RELATED APPLICATIONS

This application claims benefit and priority of the Applicant's U.S. Non-Provisional patent application Ser. No. 18/235,520, filed Aug. 18, 2023, titled "INTERLOCKING BASKET SYSTEM," and U.S. Provisional Patent Application No. 63/400,550, filed Aug. 24, 2022, titled "INTERLOCKING BASKET SYSTEM," which are incorporated herein by reference in their entirety for all purposes.

FIELD

The described embodiments relate generally to systems and methods for storage containers and more specifically to interlocking basket or storage containers and systems.

BACKGROUND

Storage containers of a variety of different sizes or material types are used to store different items, e.g., plastic storage bins, baskets, or containers are used both inside and outside of the home to store everything from clothes, to home improvement parts and tools, food, and the like. Given the unused storage volume space included in storage containers, it may be expensive and difficult to ship storage containers, such as storage bins or baskets, from a manufacturer (e.g., factory) to a point of sale location or a user's location (e.g., retail store or user's home). For example, storage containers may encompass a large volume within a shipping container, such as a truck bed space or cargo area, where a large amount of the space may be dedicated to the unused volume of the storage container. In other words, because storage containers are meant to define a large volume to receive items and goods in use, an even larger volume may be required to ship the storage containers to a desired location. Similarly, storage containers may require substantial shelf space at the point of sale location or in a user's home when not in use. As such, there is a need in the art for an improved storage container.

SUMMARY

In one embodiment, a storage container is disclosed. The storage container includes a plurality of sidewalls and a bottom wall operably coupled to the plurality of sidewalls. The bottom wall and the plurality of sidewalls together define a storage cavity. A storage container also includes a support bracket that transitions from a first position where the support bracket is contained within an exterior perimeter of the bottom wall to a second position where the support bracket extends past the exterior perimeter of the bottom wall. The support bracket may be used to support the storage container on an adjacent storage container, such that the storage container can be nested within an adjacent storage container or positioned above the adjacent storage container.

In some implementations, the support bracket comprises at least one coupling feature configured to secure the support bracket to another storage container.

In some implementations, the support bracket comprises a stop that defines a maximum length of movement of the support bracket from the first position to the second position.

In some implementations, the plurality of sidewalls comprise a back wall and a front wall, wherein the front wall has a height that is lower than a height of the back wall.

In some implementations, the storage container further includes a bottom edge operably coupled to the plurality of sidewalls and the bottom wall, the bottom edge defining in part a support surface for the storage container. In these and other implementations, the bottom edge comprises a bracket cutout and the support bracket is at least partially received within the bracket cutout. In these and other implementations, in the first position, an outer surface of the support bracket extends across and at least partially fills the bracket cutout.

In some implementations, the storage container further includes a first guide wall and a second guide wall coupled to the bottom wall, the first guide wall and the second guide wall defining a movement path for the support bracket between the first position and the second position.

In another embodiment, a storage system is disclosed. The storage system may include a first storage container including a first support bracket that moves between a retracted position and a deployed position and a second storage container defining a storage cavity. When the first support bracket is in the retracted position, the first storage container is stackable on the second storage container such that the first support bracket is nested at least partially within the storage cavity of the second storage container. When the first support bracket is in the deployed position, the first storage container is stackable on the second storage container such that the first storage container is positioned above the storage cavity of the second storage container.

In some implementations, in the deployed position, the first support bracket secures the first storage container to the second storage container. In these and other implementations, in the deployed position the first support bracket couples to an outer rim of the second storage container.

In some implementations, in the retracted position, the first support bracket is inset within an exterior perimeter of a bottom edge of first storage container, and, in the deployed position, the first support bracket extends outside of the exterior perimeter of the bottom edge of the first storage container.

In some implementations, the second storage container comprises an outer rim, the first support bracket being configured to securely couple to the outer rim of the second storage container in the deployed position. In these and other implementations, the first support bracket comprises a coupling feature configured to receive a portion of the outer rim.

In some implementations, the first storage container includes a securing member extending from a bottom edge, and the second storage container includes a securing aperture defined in an upper portion of the second storage container, the securing member being configured to be received within the securing aperture when the first storage container is positioned above the storage cavity of the second storage container.

In some implementations, the first support bracket includes a stop element configured to limit a movement path of the first support bracket.

In yet another embodiment, a storage container is disclosed. The storage container includes a front wall, a rear wall, a first sidewall, a second sidewall, and a bottom wall, where the front wall, the rear wall, the first sidewall, and the second sidewall are coupled to the bottom wall and collectively define a storage compartment. A support bracket is coupled to the bottom wall and movable between a retracted position and a deployed position. In the retracted position, the support bracket is inset within an outer perimeter of the bottom wall and in the deployed position, the support bracket extends past the outer perimeter of the bottom wall.

In some implementations, the support bracket is configured to support the storage container above another storage container.

In some implementations, the support bracket includes a coupling feature configured to engage a portion of another storage container.

In some implementations, the storage container includes a bottom edge extending from the bottom wall and a securing feature defined within the bottom edge for securing the storage container to another storage container.

In one embodiment, a storage container includes: a plurality of sidewalls; a bottom wall operably coupled to the plurality of sidewalls, together defining a storage cavity; at least one support bracket coupled to the bottom wall, movable between a first position wherein an outer surface of at least one support bracket is flush with a perimeter of the bottom wall, and a second position wherein the outer surface of the at least one support bracket extends beyond the perimeter; and a plurality of guide walls extending parallel to one another and formed adjacent to the at least one support bracket that guide the movement of the at least one support bracket between the first position and second the position.

Optionally, in some embodiments, the at least one support bracket includes: a bracket body including: a first portion, including the outer surface, that extends beyond the perimeter when the at least one support bracket is in the second position, and a second portion that does not extend beyond the perimeter when the at least one support bracket is in the second position; and the coupling feature includes a hook portion disposed at an end of the first portion and extending from the first portion toward the second portion.

Optionally, in some embodiments, the plurality of sidewalls includes a front wall, a rear wall, a left sidewall and a right sidewall, wherein the front wall is of a lower height than the rear wall and the left and right sidewalls each include respective angled transition portions connecting to the front wall.

Optionally, in some embodiments, the respective lips constrain at least one of a lateral or a vertical movement of the at least one support bracket between the first position and the second position.

Optionally, in some embodiments, the storage container further includes a bottom edge defining a support surface for the container, wherein the at least one support bracket is received within a bracket cutout of the bottom edge when in the first position.

Optionally, in some embodiments, the at least one support bracket includes a plurality of ribs extending from a bottom surface thereof.

In one embodiment, a storage system includes: a first storage container including: a plurality of sidewalls; a bottom wall operably coupled to the plurality of sidewalls; a support bracket movable between a retracted position and a deployed position, wherein at least a portion of the support bracket is flush with a perimeter of the bottom wall in the retracted position and at least a portion of the support bracket extends beyond the perimeter in the deployed position; a plurality of guide walls extending parallel to one another and formed adjacent to the support bracket that guide the movement of the support bracket between the retracted position and deployed the position; a second storage container defining a storage cavity. When the support bracket is in the retracted position, the first storage container is nestable within the storage cavity of the second storage container; and when the support bracket is in the deployed position, the first storage container is stackable on the second storage container, positioning the first storage container above the storage cavity, wherein the support bracket engages a portion of the second storage container.

In one embodiment, a stackable storage container includes: a front wall, a rear wall, a left sidewall and a right sidewall, wherein the front wall is of a lower height than the rear wall, and the left and right sidewalls each include respective angled transition portions connecting to the front wall; a support bracket coupled to the bottom wall, movable between a first position where an outer surface of the support bracket is flush with a perimeter of the bottom wall, and a second position where the outer surface extends beyond the perimeter; a plurality of guide walls extending parallel to one another and formed adjacent to the support bracket that guide the movement of the support bracket between the first position and second the position, wherein the guide walls each include a respective lip, the respective lips extend at least partially over the support bracket and constrain at least one of a lateral or a vertical movement of the support bracket between the first position and the second position.

DETAILED DESCRIPTION

Figure 1A:
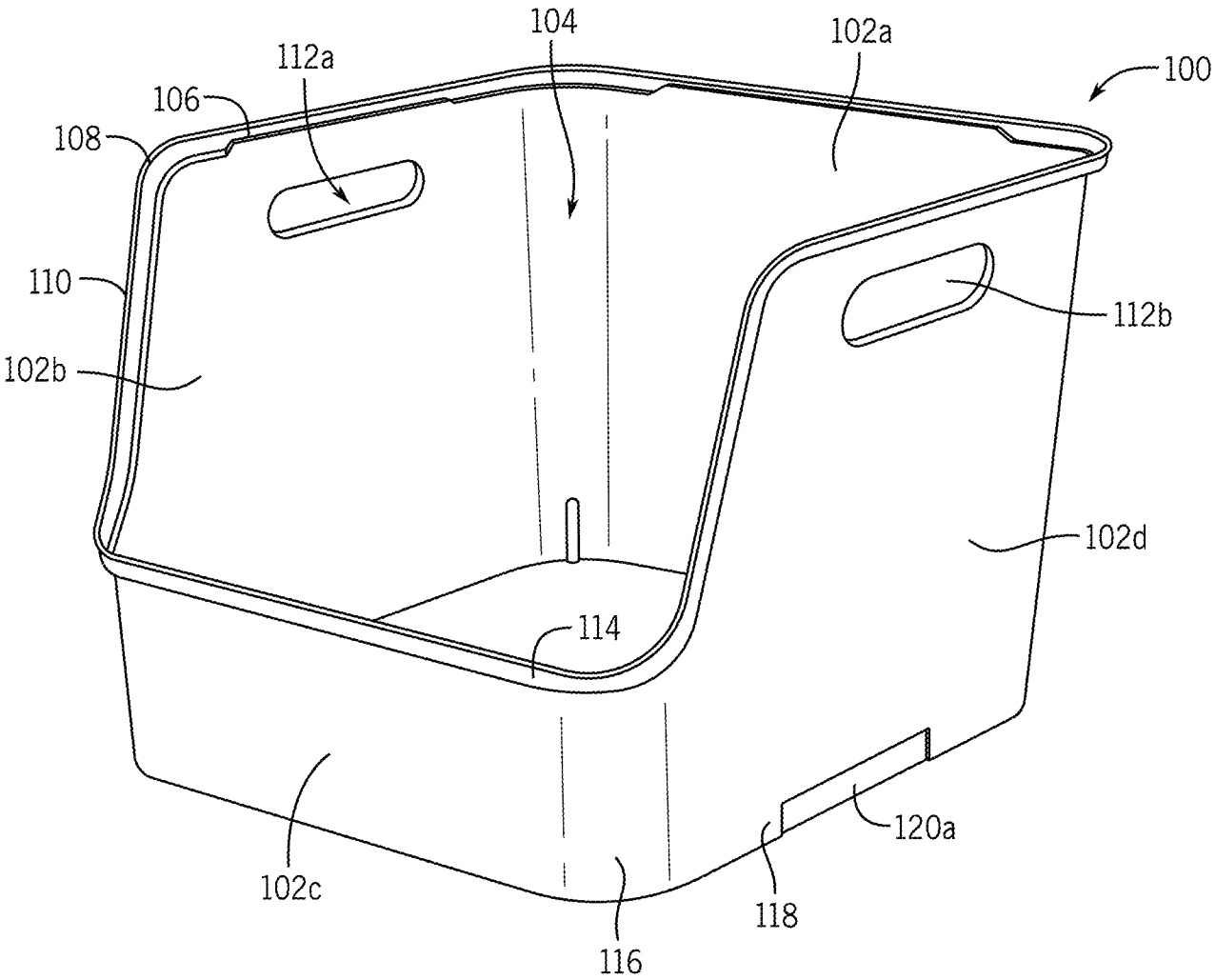
FIG. 1A is a front isometric view of a storage container.

Various embodiments include a storage container stackable in multiple configurations, e.g., a nested configuration and a stacked configuration. The storage container may include one or more support brackets that move between a first or retracted position and a second or deployed position. In the retracted position the support bracket may be inset or positioned within an exterior perimeter of the storage container, e.g., arranged to be aligned with or interior of an outer wall or bottom edge of the storage container. In the deployed position the support bracket may extend past the exterior perimeter of the storage container, e.g., arranged to extend past the outer wall or outer edge of the storage container.

The support bracket may include a coupling feature, e.g., one or more grooves or tangs, configured to couple the support bracket to another storage container. For example, in one embodiment, the support bracket may include a groove configured to receive an outer rim of another storage container. In these instances, the support bracket may couple the storage container to be arranged above the other storage container, e.g., in a manner that does not substantially decrease a storage volume of the other storage container. In instances where the support bracket is retracted, however, the storage container may be configured to seat at least partially within the other storage container, e.g., nested. In other words, the storage container can be connected, e.g., stacked, with other storage containers, in two or more configurations, where one configuration may be configured to increase or maximize the storage volume accessible in a bottom storage container and one configuration may be configured to decrease the storage volume accessible and reduce the overall height and/or volume of the stacked storage containers.

In one example, the storage container may include two support brackets that extend from opposing sides, e.g., left and right sides, and may balance and support the storage container when in the stacked configuration. Similarly, the storage container may also include one or more securing features that may be defined on another side of the storage container from the support bracket, e.g., rear side. The securing features may assist in preventing relative movement of the storage container to an adjacently stacked storage container.

The various stackable configurations allow a volume of two or more storage containers to be reduced for storage, shipping, and/or display, without requiring substantial modification of the storage containers after assembly. For example, conventional shipping solutions that reduce volume may require assembly of the storage container for use at the end point (such as at a user's house), which can be difficult and time consuming. On the contrary, the present disclosure allows the storage containers to be easily and quickly compacted for storage, shipping, display on a shelf, or the like, and readily and easily deployed for use, without requiring assembly of the product.

Figure 1B:
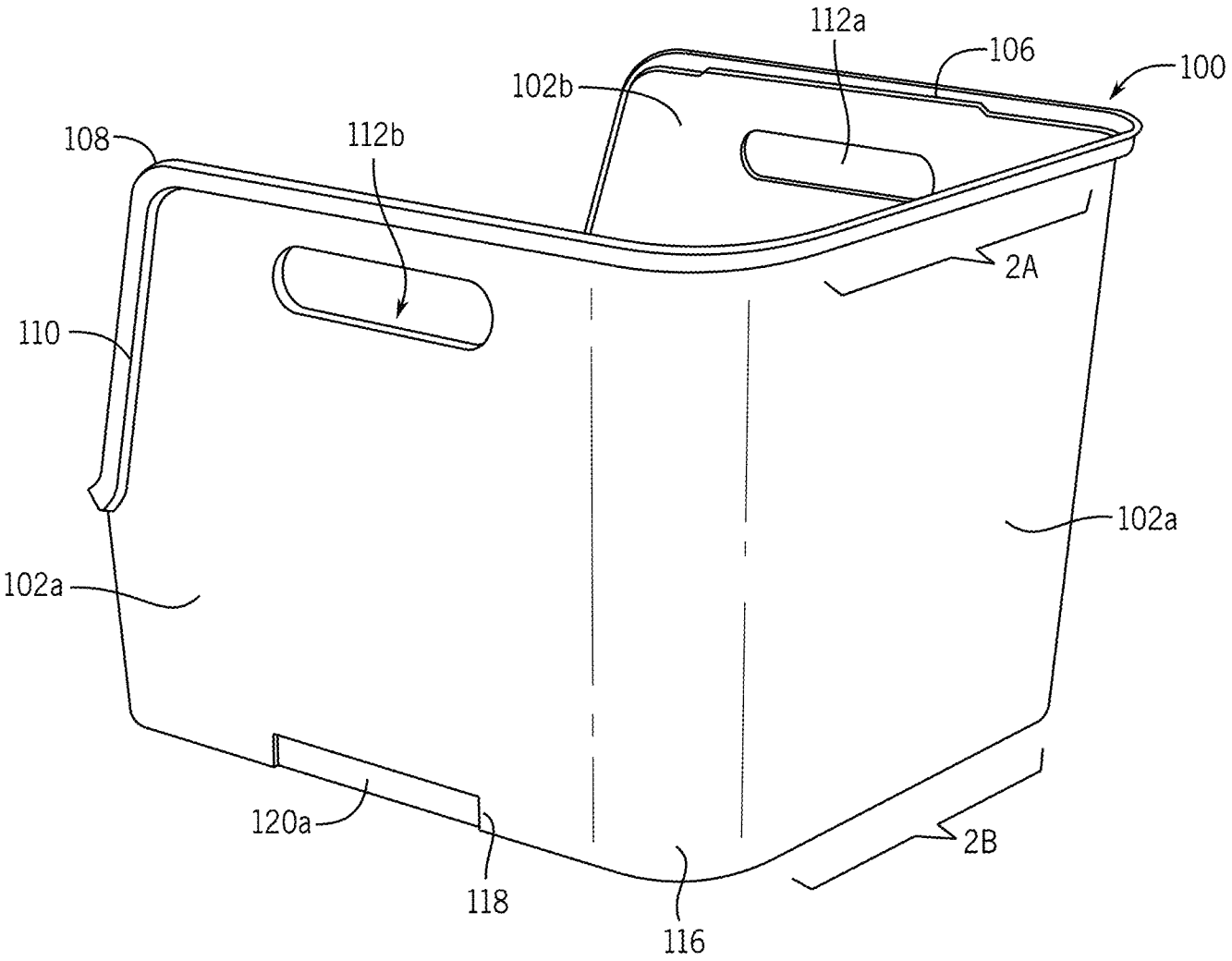
FIG. 1B is a rear isometric view of the storage container.

Turning now to the figures, the storage container and storage system will be discussed in more detail. FIGS. 1A and 1B illustrate front and rear isometric views, respectively, of a storage container 100. The storage container 100 may include one or more walls 102*a*, 102*b*, 102*c*, and/or 102*d* that define a storage cavity 104. For example, there may be two sidewalls 102*a*, 102*b*, a front wall 102*c*, and a back or rear wall 102*d*, each of which may be coupled to one another. In some embodiments, the walls 102*a*, 102*b*, 102*c*, 102*d* may have a similar height and/or width, but in other embodiments the walls 102*a*, 102*b*, 102*c*, 102*d* may have varying dimensions. For example, as shown in FIG. 1A, in one example, the front wall 102*c* may have a reduced height as compared to the other walls 102*a*, 102*b*, 102*d*, which may allow easier access to the interior storage cavity 104 from a front side of the storage container 100. However, in other embodiments, the walls 102*a*, 102*b*, 102*c*, 102*d* may be differently configured, e.g., the back wall 102*d* may also have a lower height as compared to the sidewalls 102*a*, 102*b*.

Figure 9:
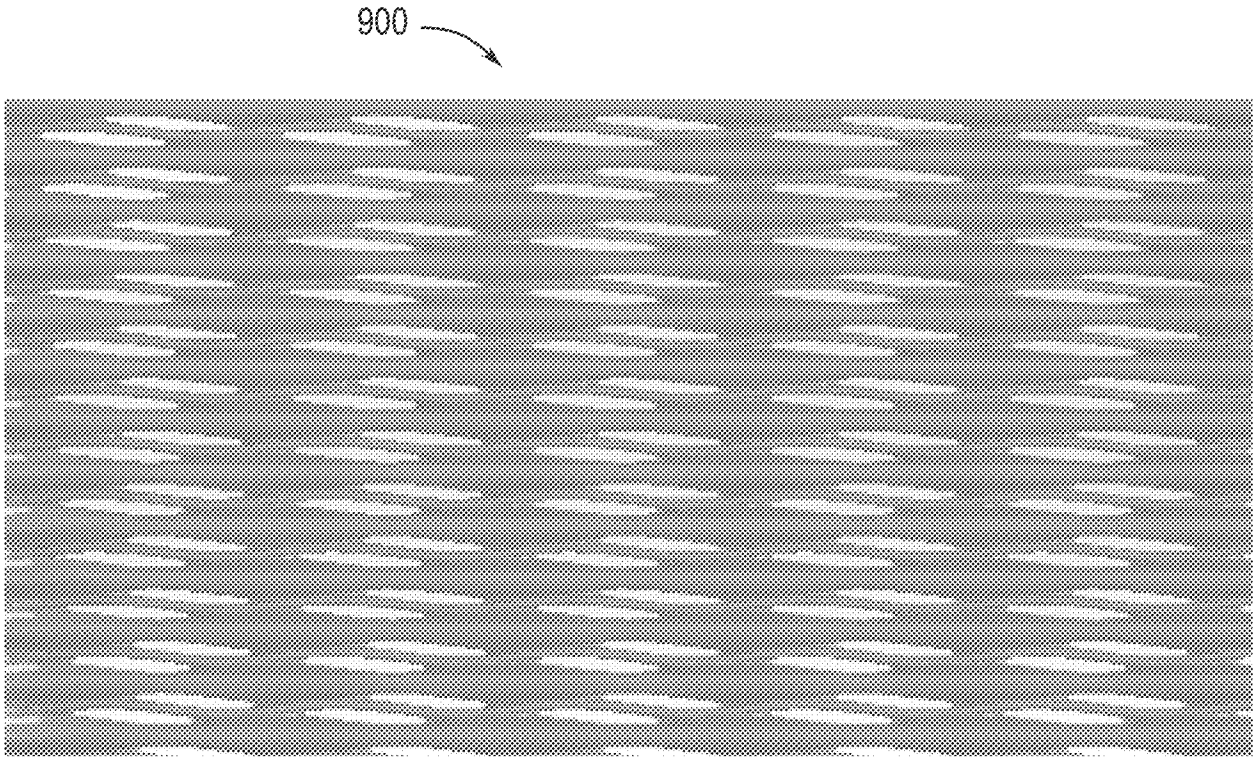
FIG. 9 is an enlarged view of a pattern for a storage container.
Figure 10A:
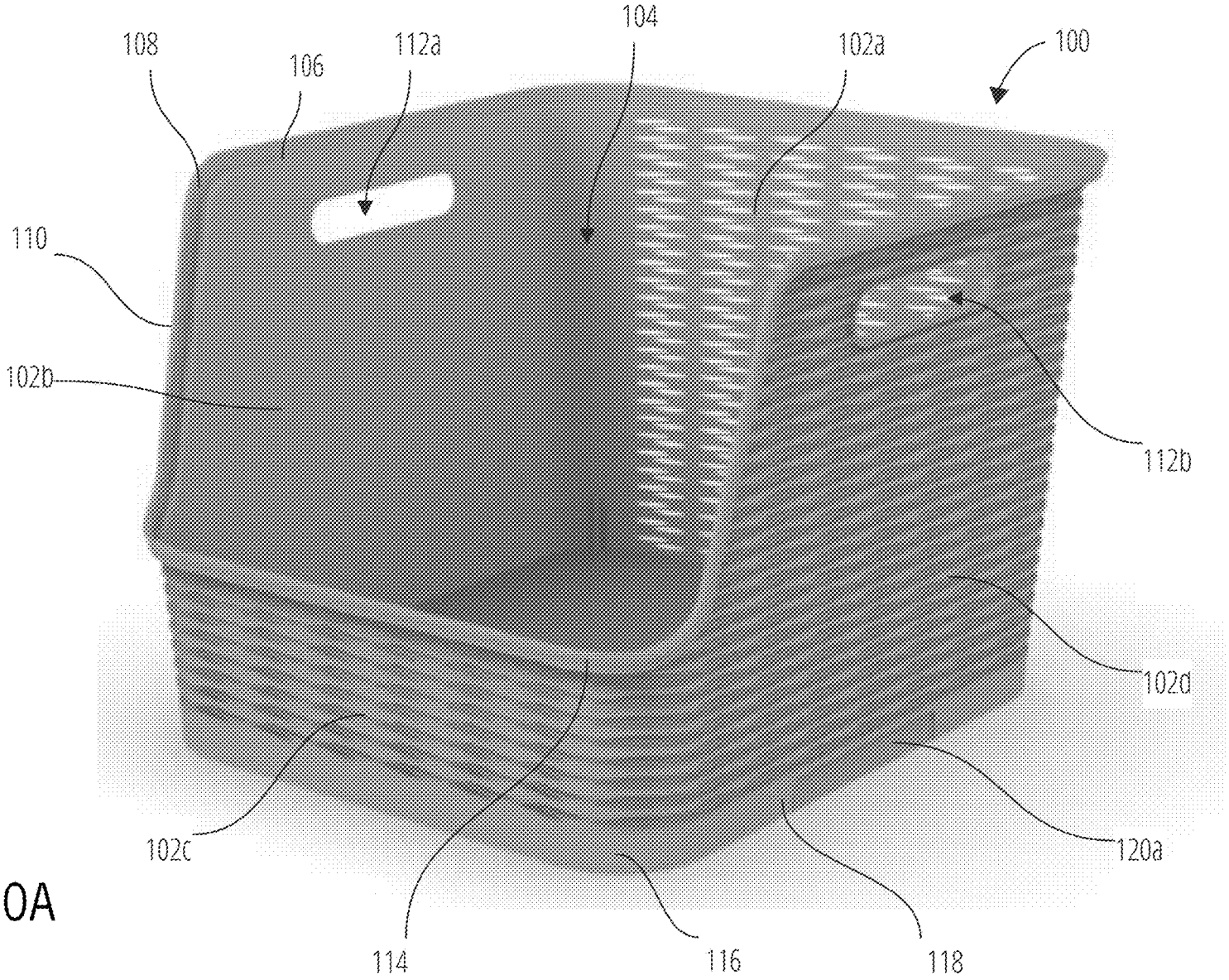
FIG. 10A illustrates a front isometric view of another example of the storage container of FIG. 1A.
Figure 10B:
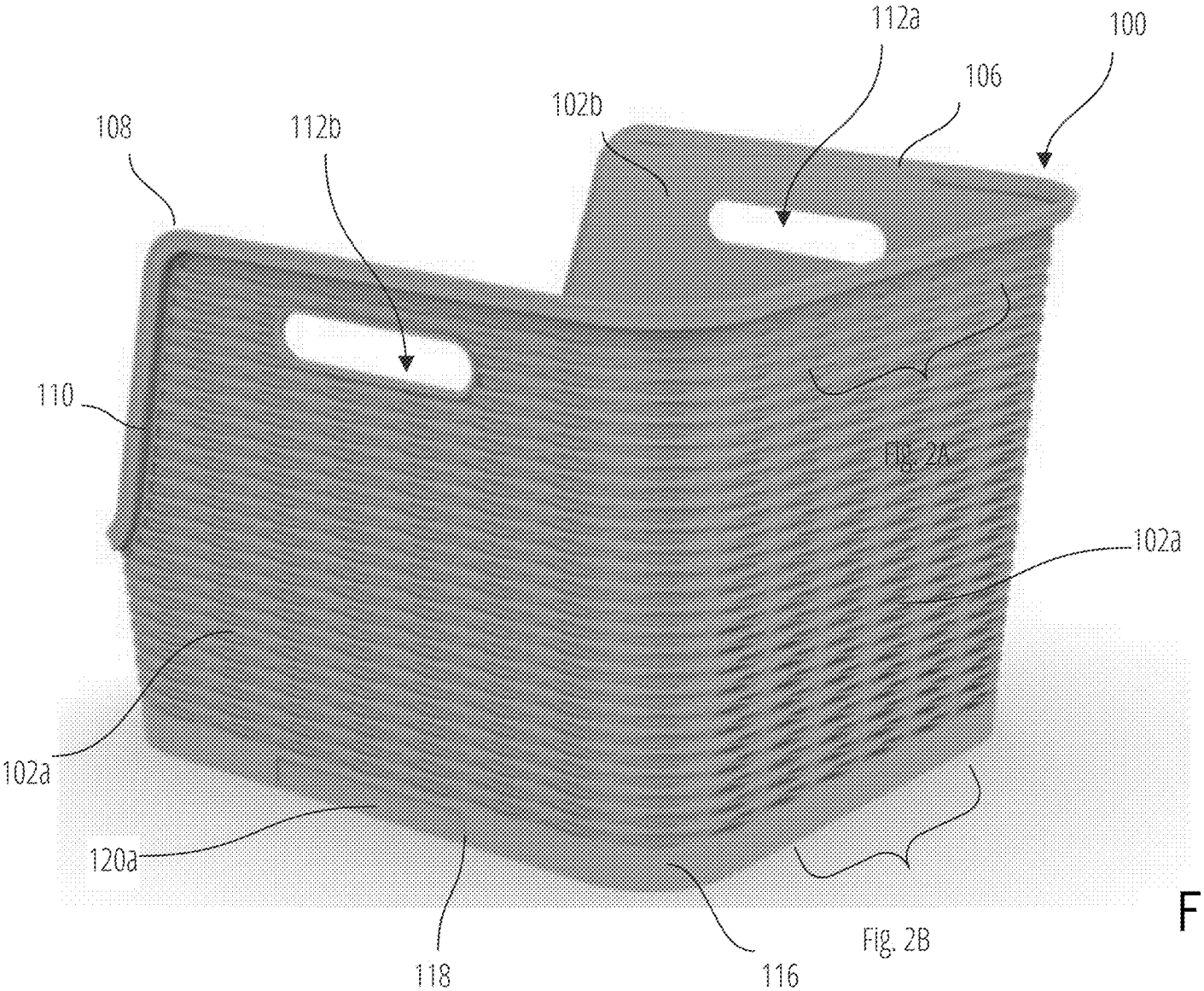
FIG. 10B illustrates a rear isometric view of the storage container of FIG. 10A.
Figure 11A:
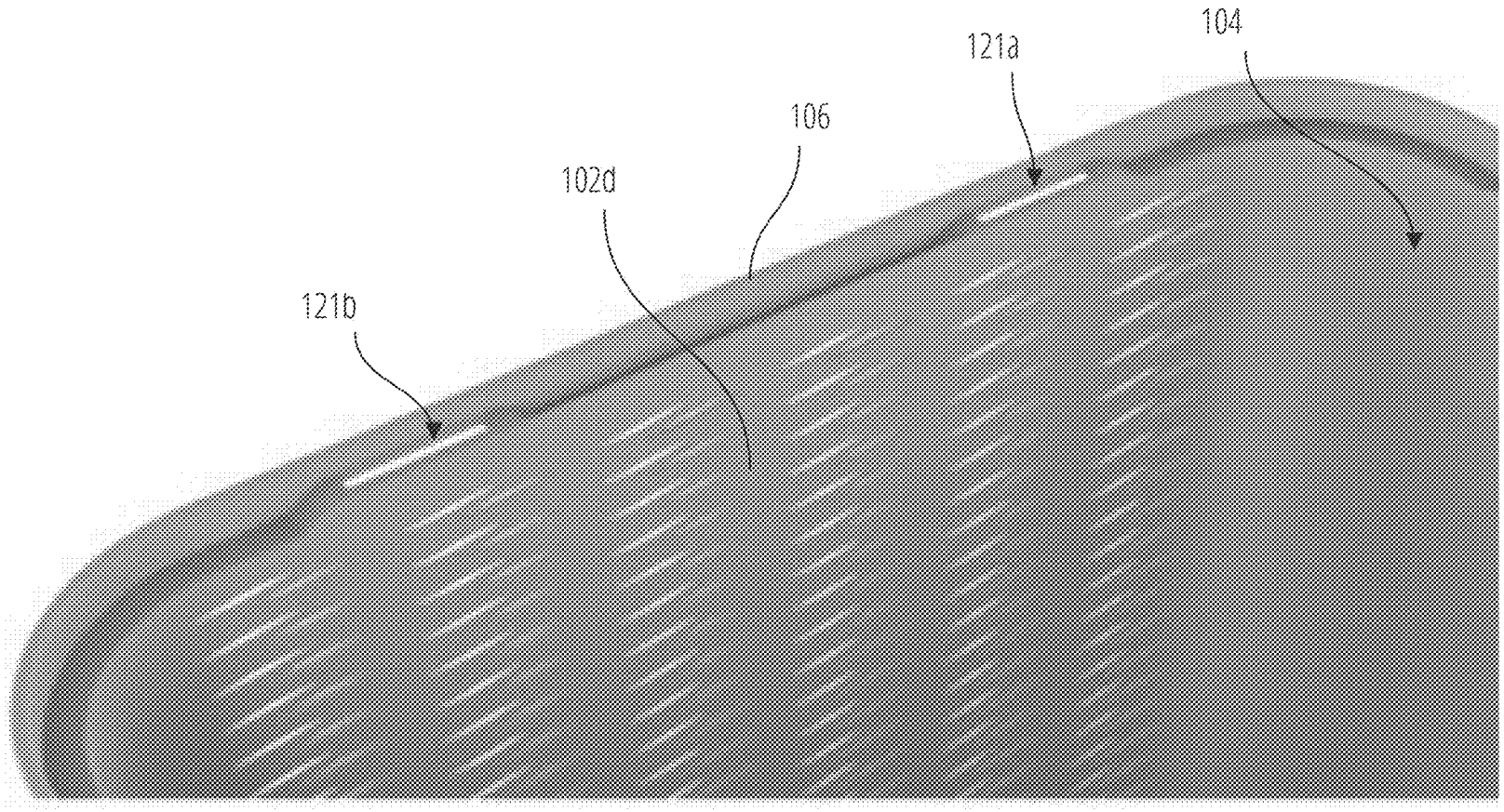
FIG. 11A illustrates an enlarged view of the storage container as shown in FIG. 10B.
Figure 11B:
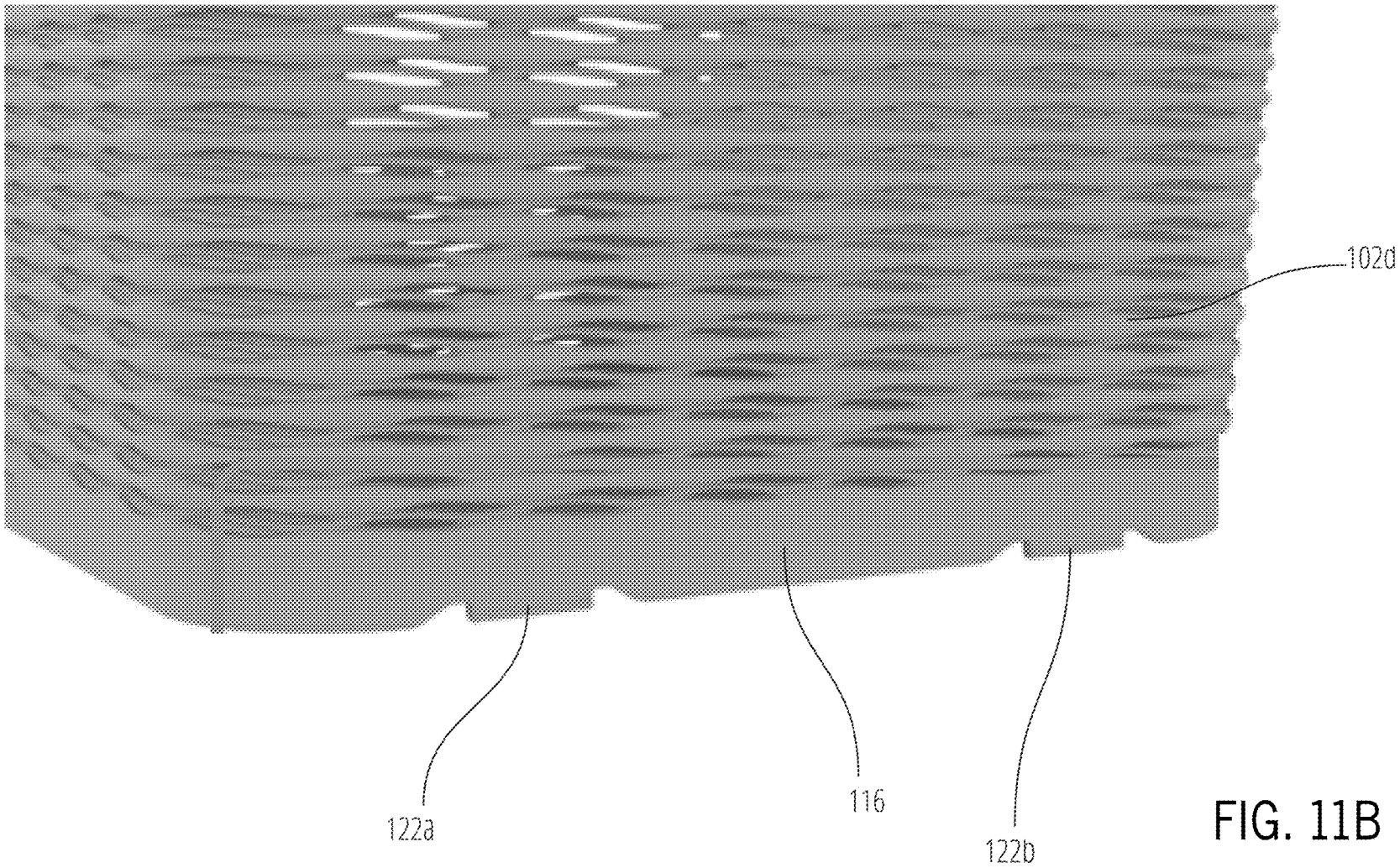
FIG. 11B illustrates a rear enlarged view of the storage container as shown in FIG. 10B.
Figure 12A:
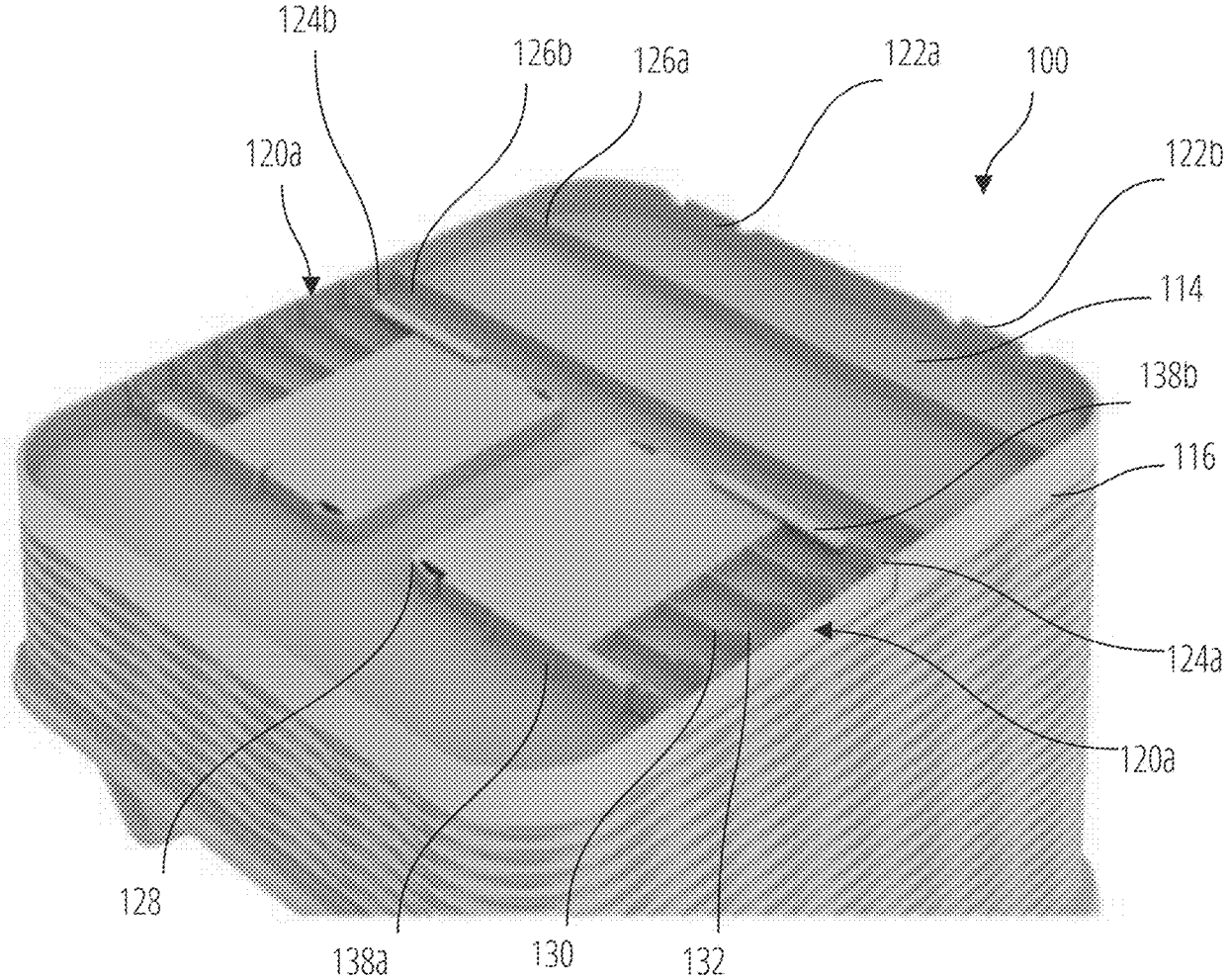
FIG. 12A illustrates a bottom isometric view of the storage container as shown in FIG. 10B.
Figure 12B:
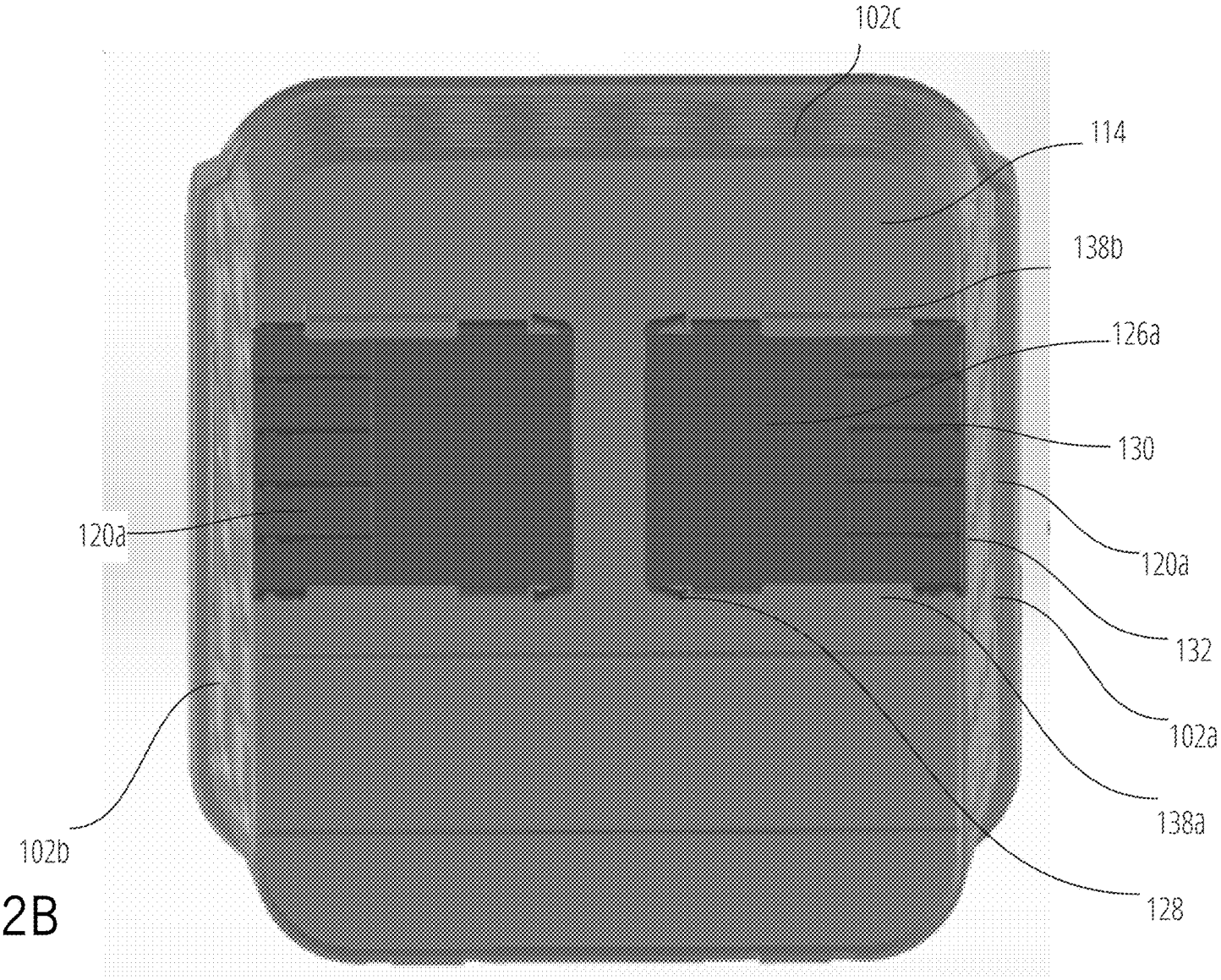
FIG. 12B illustrates a bottom plan view of the storage container as shown in FIG. 10B.
Figure 13:
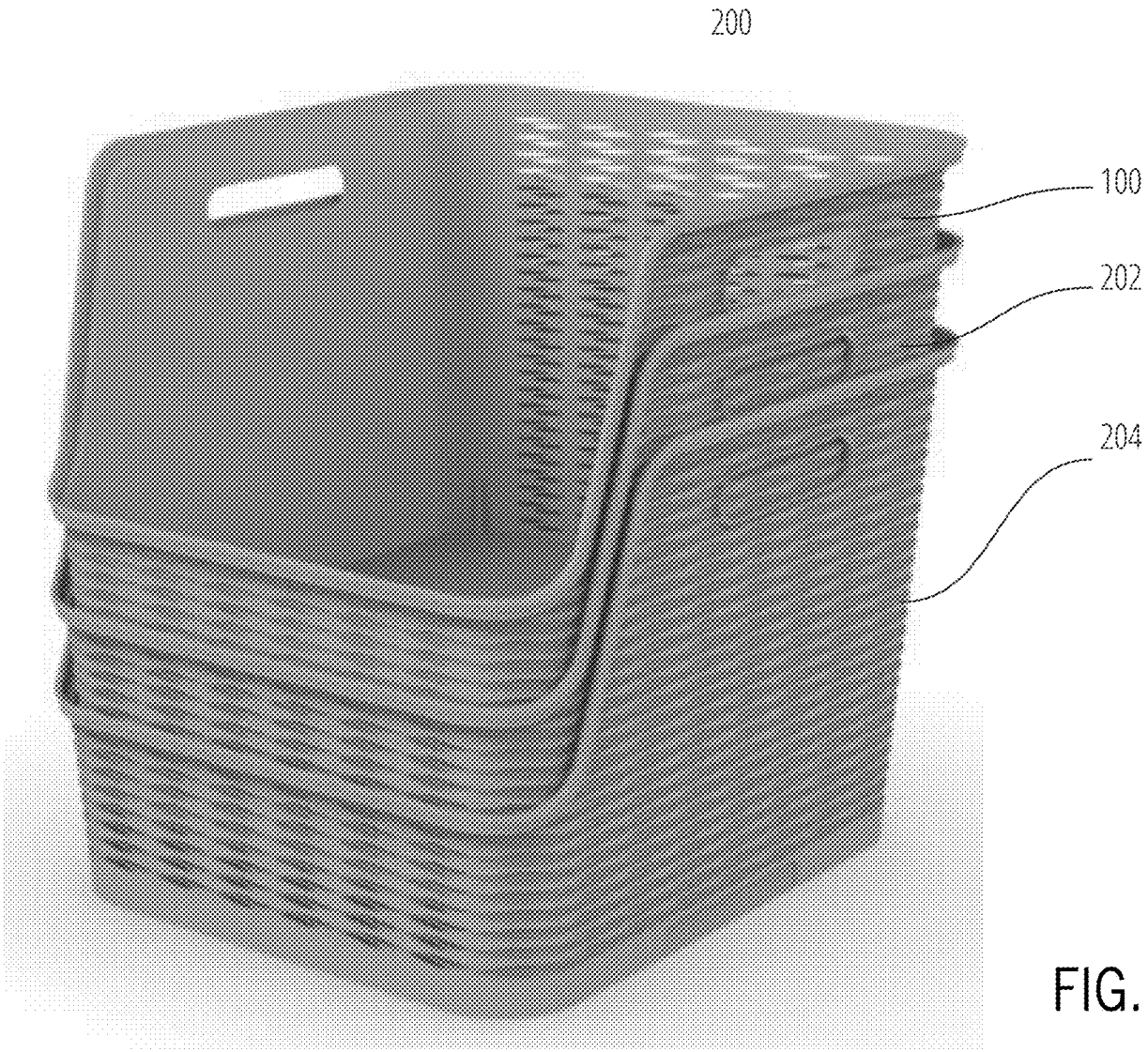
FIG. 13 illustrates a front isometric view of a system of nested storage containers including the storage container of FIG. 10B.
Figure 14A:
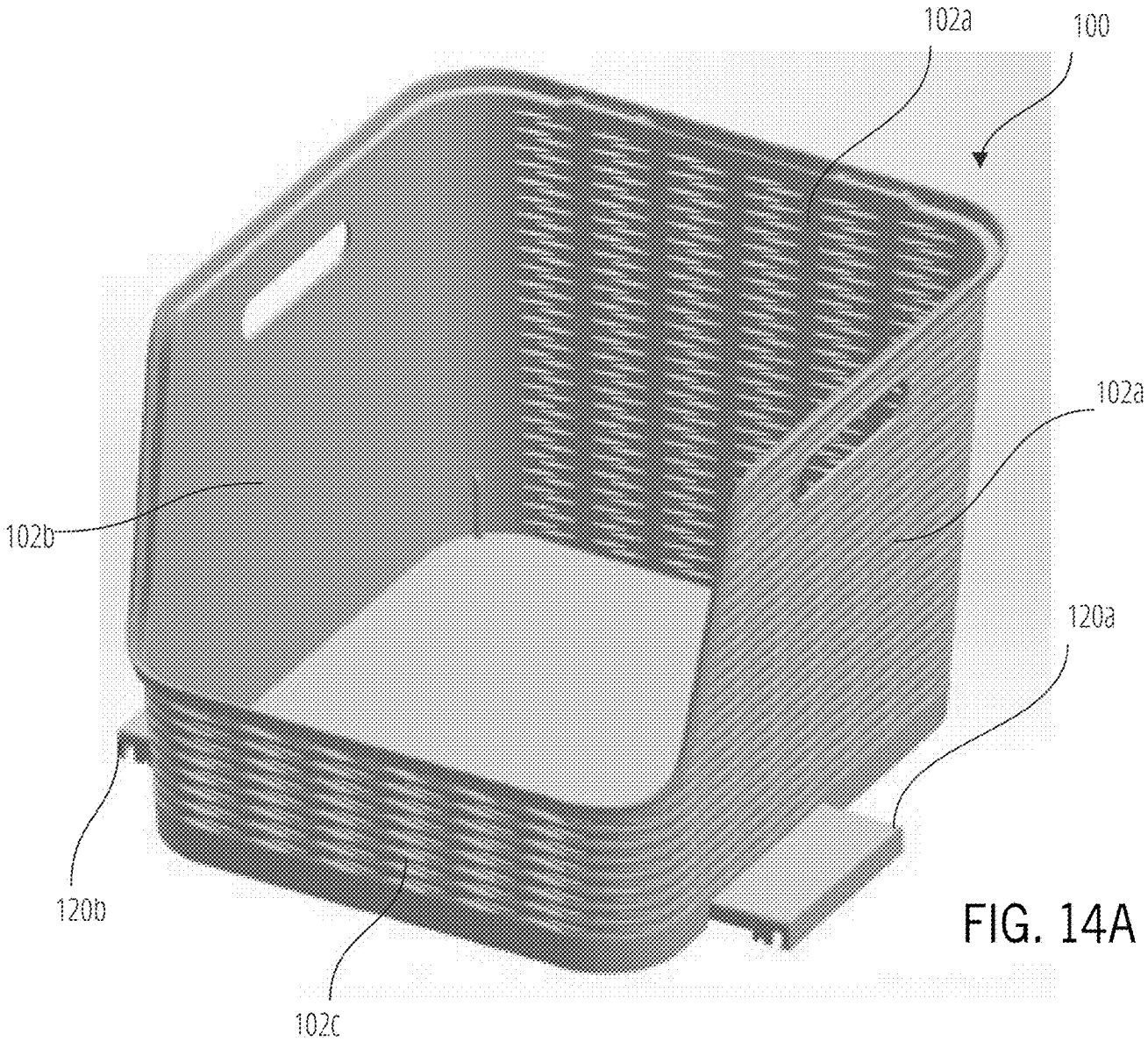
FIG. 14A illustrates a front isometric view of the storage container of FIG. 10B with a support bracket in a deployed position.
Figure 14B:
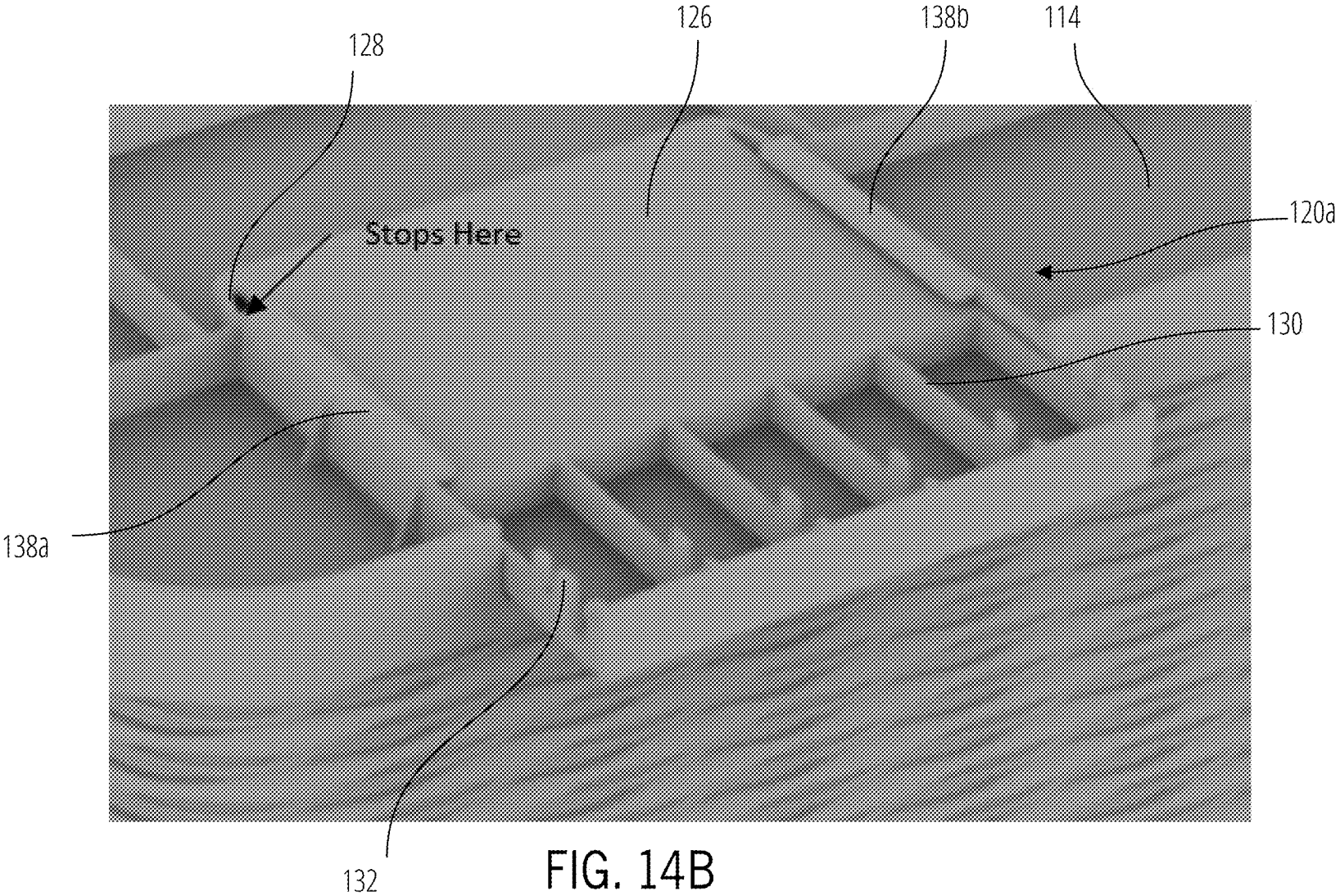
FIG. 14B illustrates an enlarged bottom isometric view of the storage container of FIG. 14A.
Figure 15:
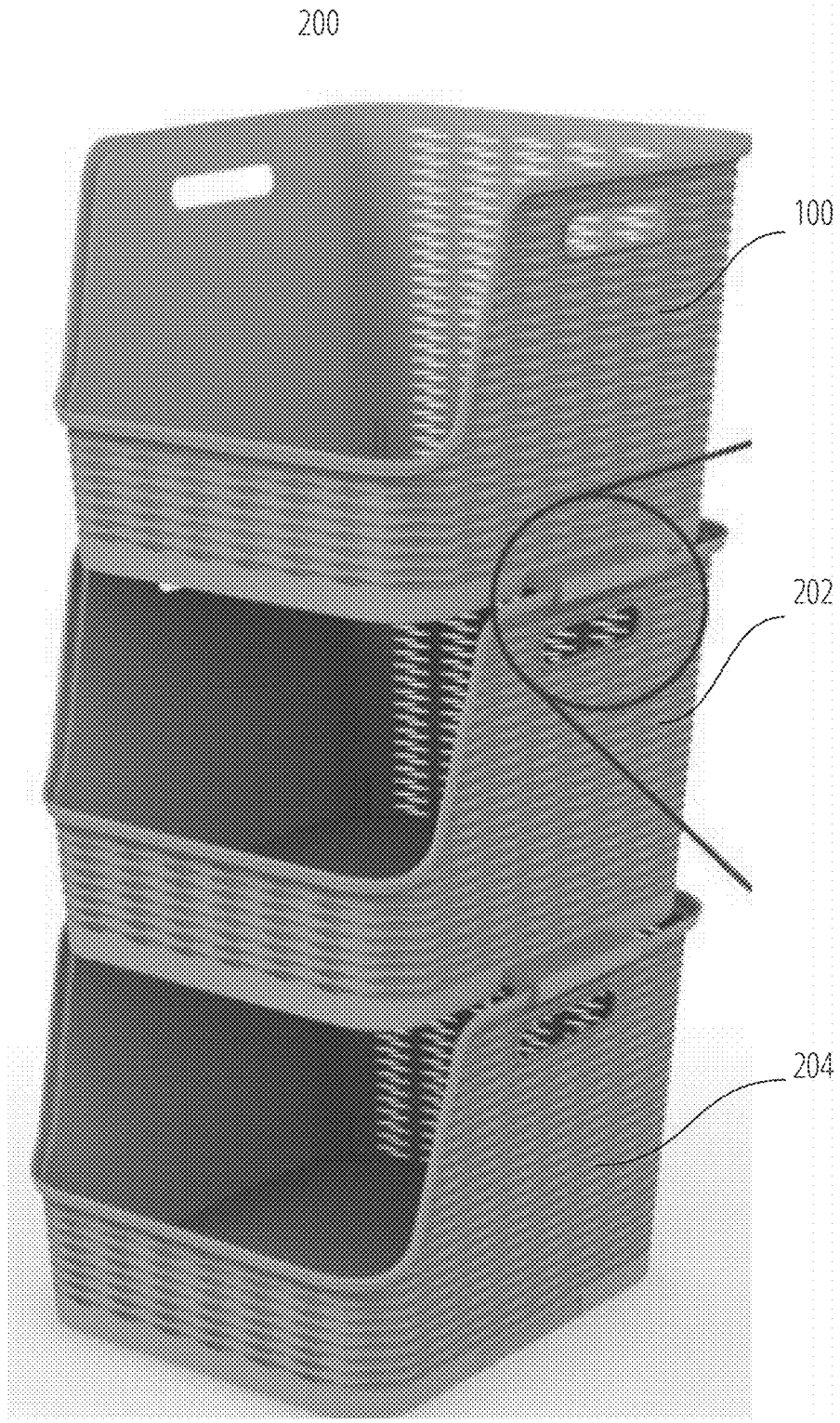
FIG. 15 illustrates a front isometric of a system of stacked storage containers.
Figure 16A:
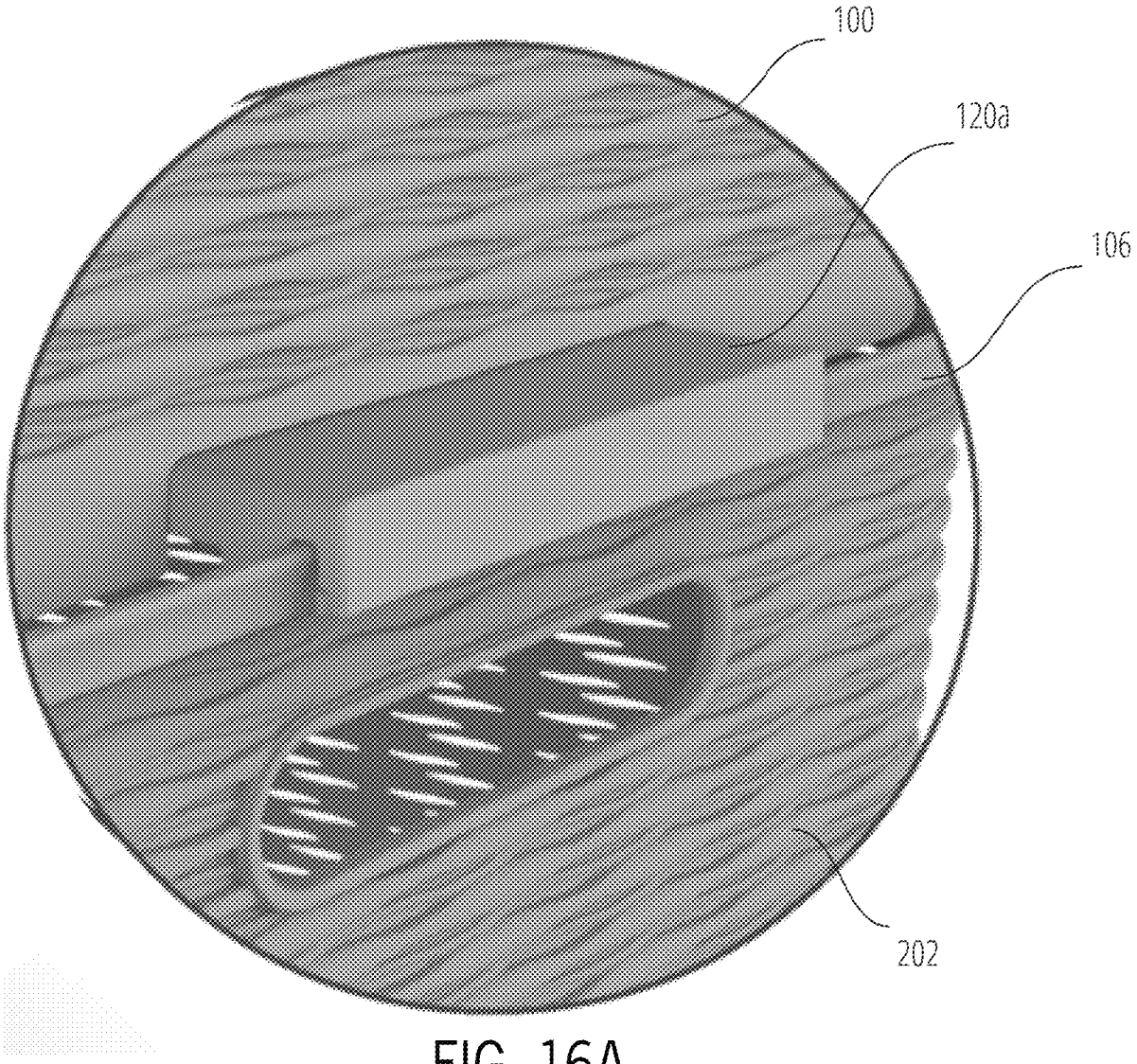
FIG. 16A illustrates an enlarged view of the system of stacked storage containers of FIG. 15.
Figure 16B:
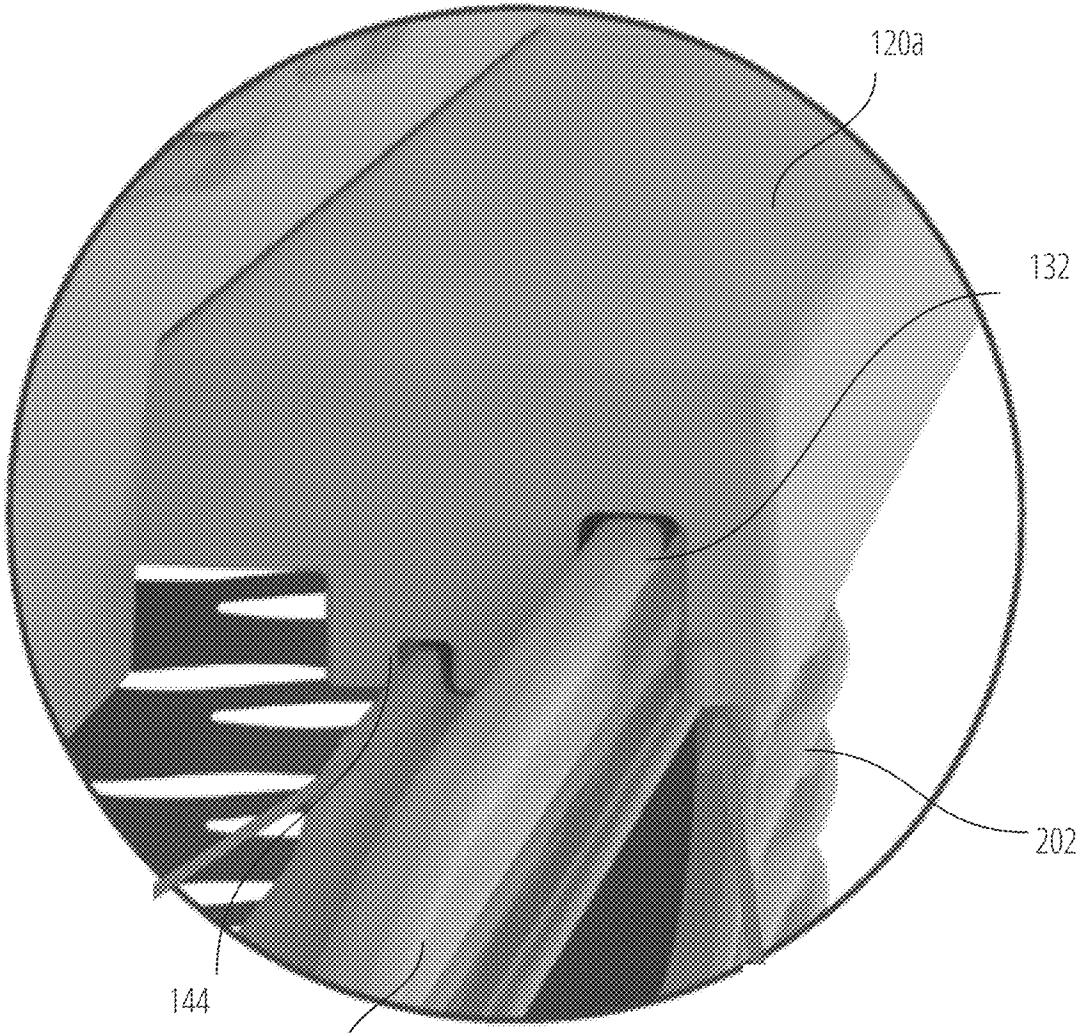
FIG. 16B illustrates another enlarged view of the system of stacked storage containers of FIG. 15.
Figure 17:
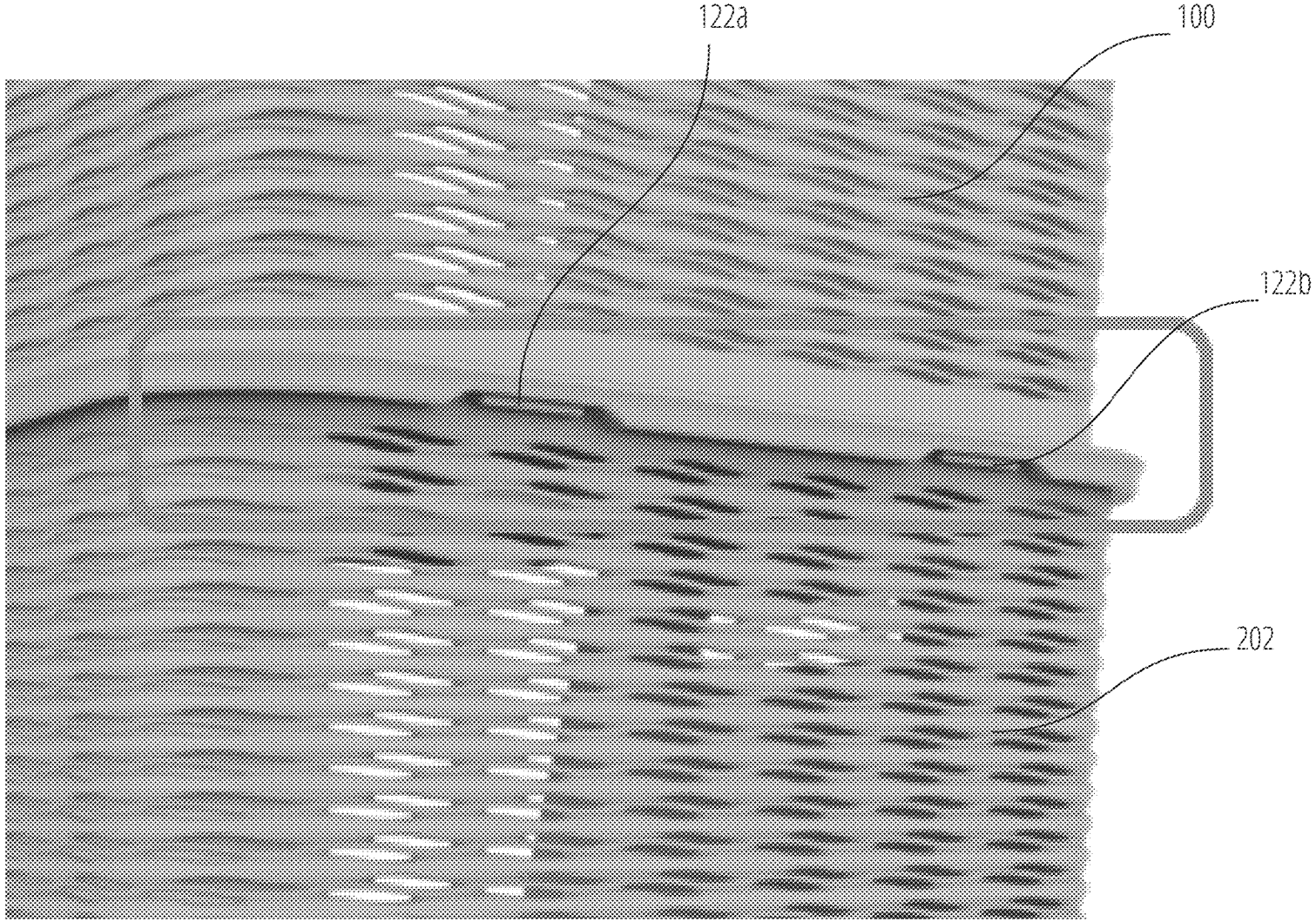
FIG. 17 illustrates another enlarged view of the storage container of FIG. 15.

The walls 102*a*, 102*b*, 102*c*, 102*d* may optionally be formed of a weave or basket pattern that may provide strength at a low weight to the storage container 100 (See FIG. 9). Additionally, the pattern or weave of the walls 102*a*, 102*b*, 102*c*, 102*d* may be selected to be aesthetically pleasing.

The walls 102*a*, 102*b*, 102*c*, 102*d* may terminate at a top edge to define a rim 106 for the storage container 100. The rim 106 may define the top surface or edge of the storage container 100 and in some embodiments may define a maximum perimeter of the storage container 100 in the first configuration. In some embodiments, such as shown in FIGS. 1A and 1B, the rim 106 may have a varied height, e.g., extend along a height of the various walls 102*a*, 102*b*, 102*c*, 102*d*. For example, the rim 106 may include a transition area 108 where the rim 106 extends from a top height corresponding to the sidewalls 102*a*, 102*b* to a lower height corresponding to a top of the front wall 102*c*. In this manner, the rim 106 may include an angled portion 110 that follows along a cutout or angled portion of the sidewalls 102*a*, 102*b* as the height may change from the sidewalls 102*a*, 102*b* to the front wall 102*c*. However, in other implementations, the rim 106 may be configured to have a similar continuous height or multiple other varied heights.

Figure 2A:
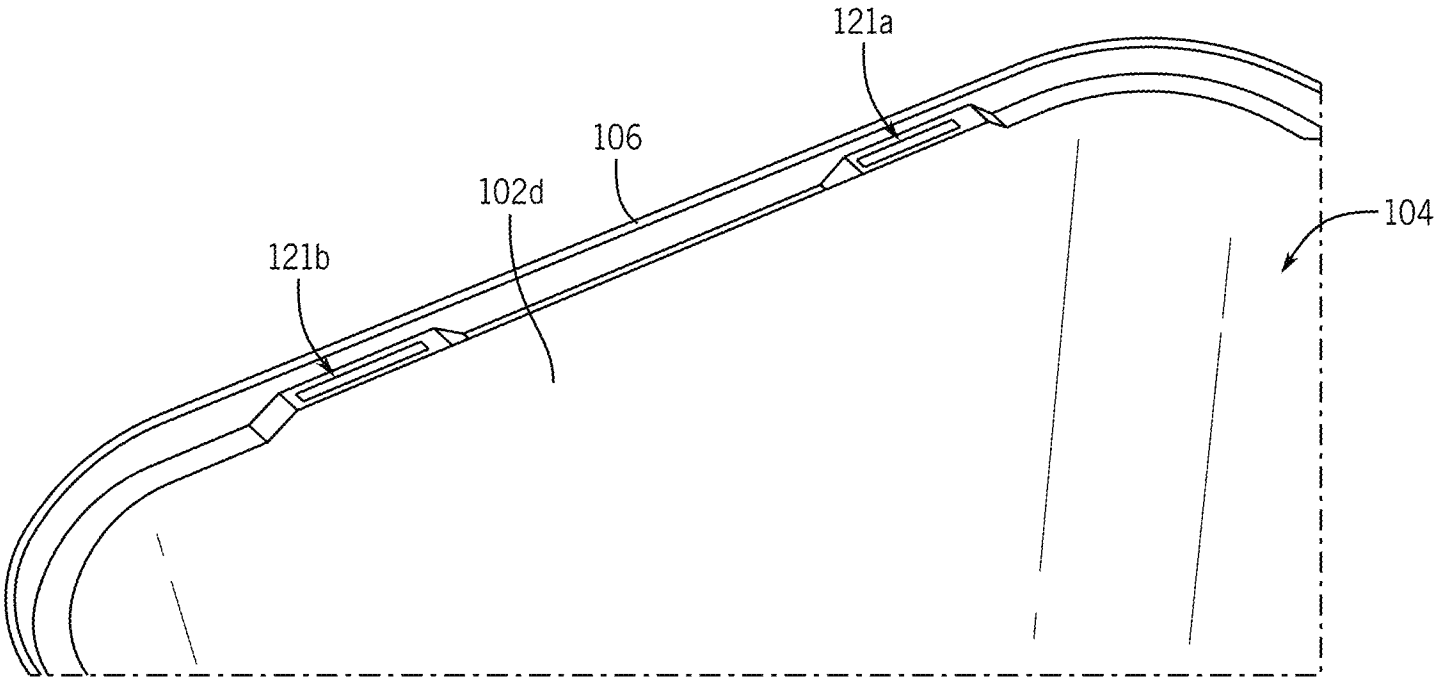
FIG. 2A is an enlarged view of the storage container as shown in FIG. 1B.

In some embodiments, the rim 106 may include coupling features, such as one or more grooves or tracks that may receive a coupling or securing element from another storage container 100. More specifically, with reference to FIG. 2A, the rim 106 may include one or more securing features 121*a*, 121*b* defined therein. In one example, the securing features 121*a*, 121*b* or securing members may be defined as apertures or cutouts in the rim 106 or within one of the walls 102*a*, 102*b*, 102*c*, 102*d* and be configured to receive securing elements of an adjacent storage container or other elements. In one embodiment, the securing features 121*a*, 121*b* may be defined as aligned apertures on the back wall 102*d* of the storage container 100, but in other configurations may be differently configured.

In some embodiments, the storage container 100 may include one or more handle apertures 112*a*, 112*b*, that may define a gripping area for a person. For example, in one embodiment, the storage container 100 may include two handle apertures 112*a*, 112*b* defined in opposing walls, e.g., in sidewalls 102*a*, 102*b*. The handle apertures 112*a*, 112*b* may be defined as cutouts of any shape, such as oblong oval/ovoid or circular cutouts that allow a user to more easily position his or her hand in a manner to lift, slide, or otherwise move the storage container 100. It should be noted that while the handles in FIGS. 1A and 1B are disclosed as apertures, in other embodiments, griping areas may be otherwise defined, such as shelves, brackets, or the like and may be positioned at other locations on the storage container 100.

With continued reference to FIGS. 1A and 1B, the storage container 100 may also include a bottom wall 114 that may define an interior bottom surface of the storage cavity 104. The bottom wall 114 may be coupled to the various vertical walls, e.g., walls 102*a*, 102*b*, 102*c*, 102*d*.

Figure 2B:
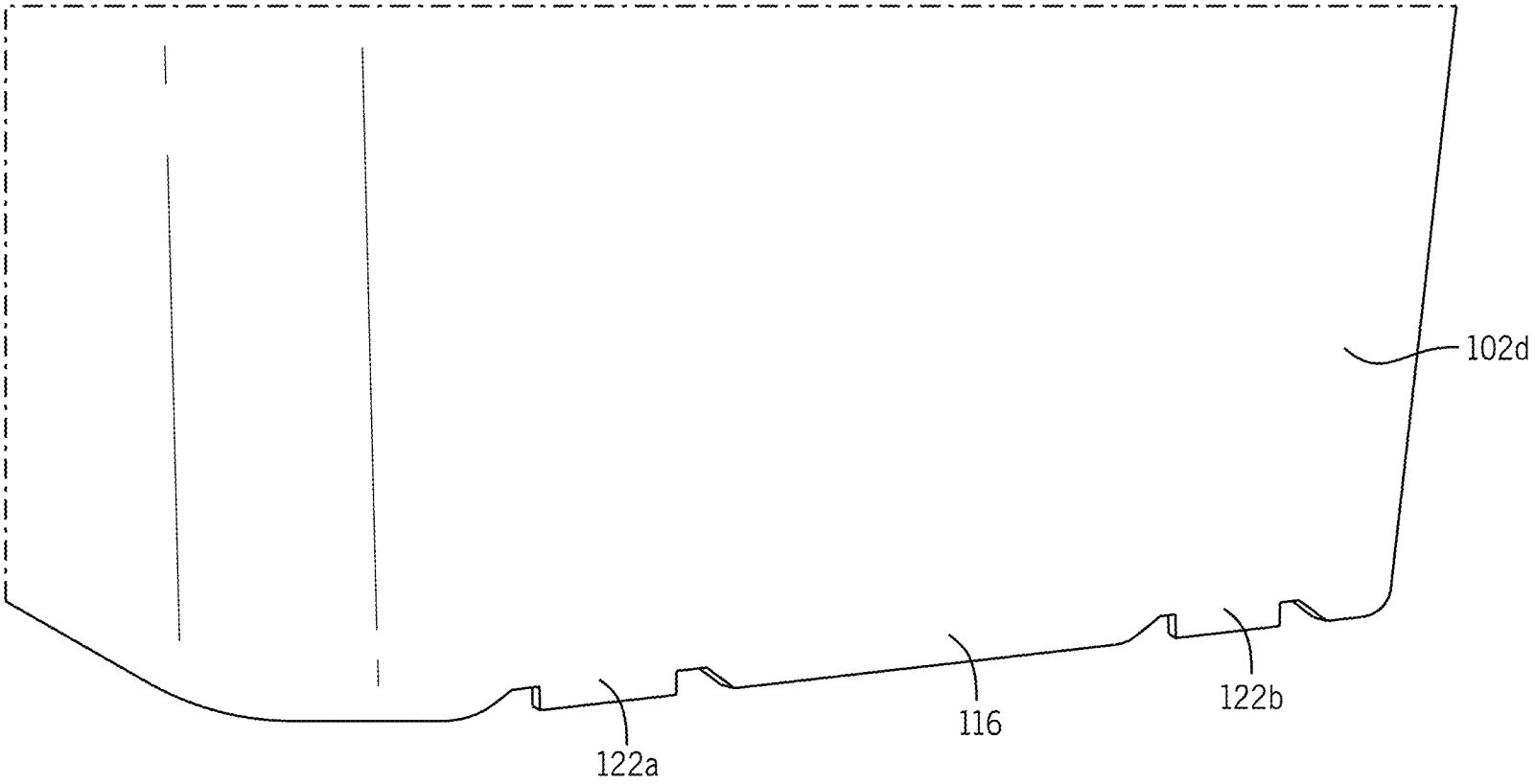
FIG. 2B is a rear enlarged view of the storage container as shown in FIG. 1B.
Figure 3A:
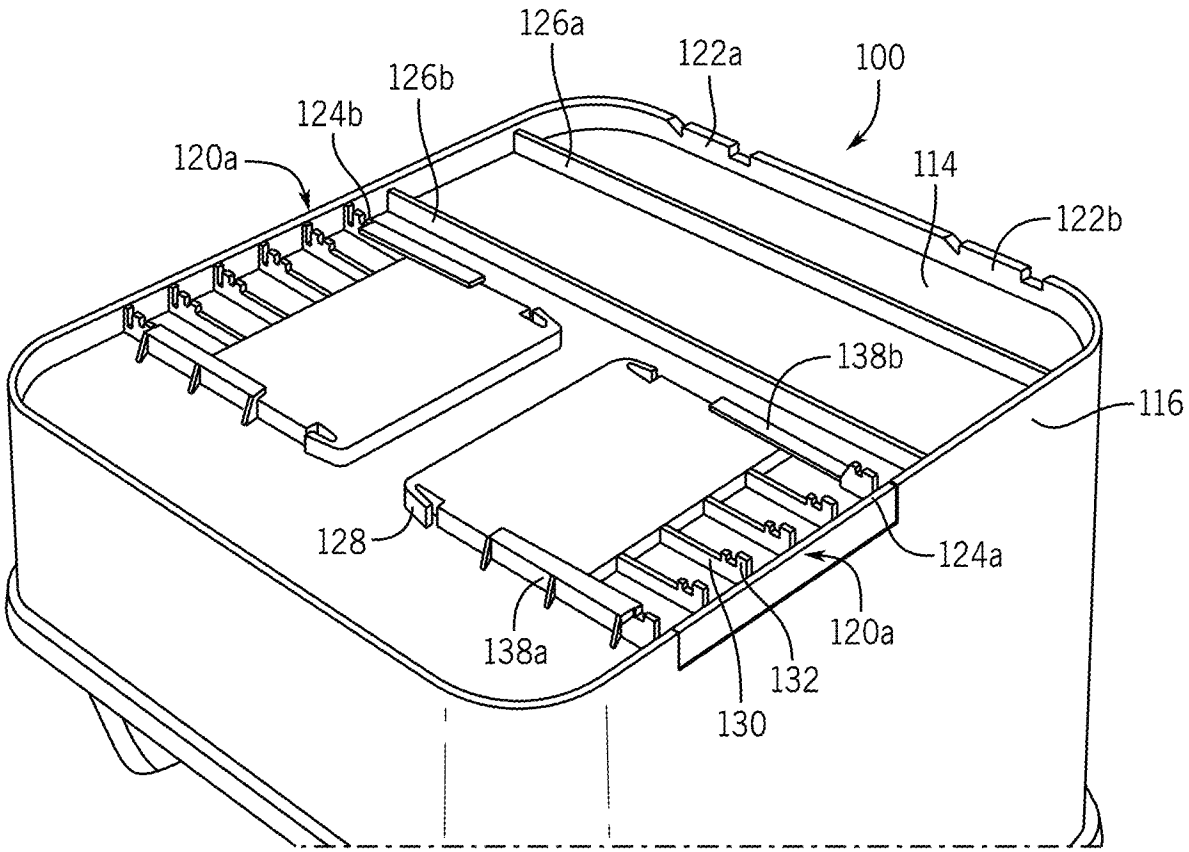
FIG. 3A is a bottom isometric view of the storage container.
Figure 3B:
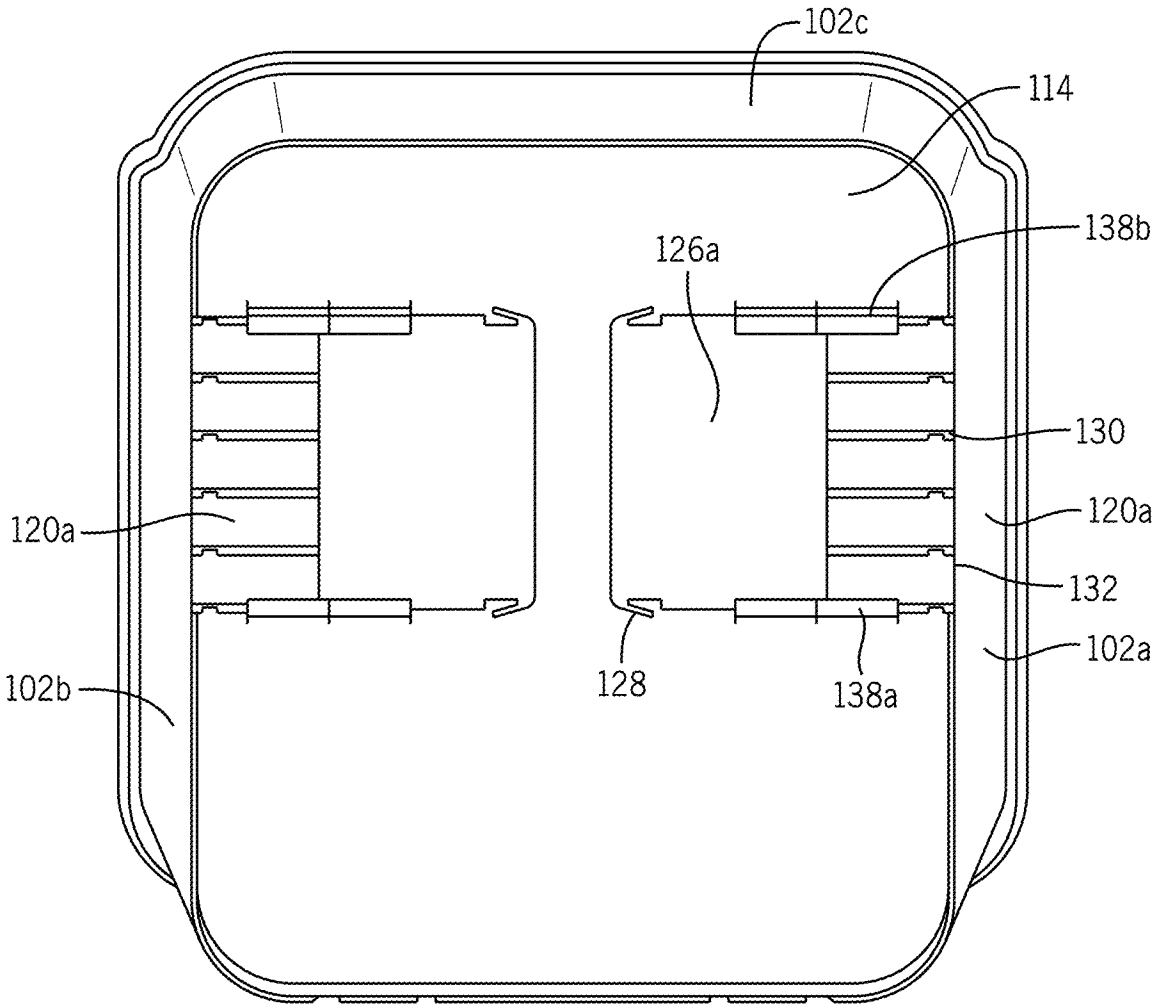
FIG. 3B is a bottom plan view of the storage container.

FIGS. 3A and 3B illustrate bottom views of the storage container 100. With reference to FIGS. 2B, 3A, and 3B, a bottom edge 116 may be defined on a bottom end of the walls 102*a*, 102*b*, 102*c*, 102*d* and be configured to support the storage container 100 on a support surface, such as a floor, counter, shelf, or the like. The bottom edge 116 may define one or more cutouts or recesses along its perimeter. For example, as shown in FIGS. 2B and 3A, the bottom edge 116 may include one or more securing elements 122*a*, 122*b*, which may be defined as one or more cutouts to define tangs or tabs that may be configured to be received within corresponding apertures (e.g., 121*a* and 121*b* of FIG. 2A) in another storage container 100 or other element. In one example, the securing elements 122*a*, 122*b* may be defined as two cutouts that together define a tab portion of the bottom edge 116, but other variations are anticipated. In one embodiment, the securing elements 122*a*, 122*b* may be aligned with and adjacent to the back walls 102*d* of the storage container 100, but other implementations are envisioned as well.

The bottom edge 116 may also include a bracket cutout 124*a*, 124*b* that may be configured to receive a portion of a support bracket. In one example, the bottom edge 116 may include two bracket cutouts 124*a*, 124*b*, which may be defined on opposing sides of the bottom edge 116, e.g., adjacent to the two sidewalls 102*a*, 120*b*. In the retracted position, an outer surface of the support brackets (discussed below) may "fill" the cutouts.

With continued reference to FIGS. 3A and 3B, the storage container 100 may also include one or more ribs 126*a*, 126*b* to provide additional support and rigidity to the storage container 100. In one example, the ribs 126*a*, 126*b* may be coupled to the bottom wall 114 and may be configured to extend along a length and/or width of the storage container 100. For example, in one embodiment the ribs 126*a*, 126*b* may extend along a width of the storage container 100, such as between the two sidewalls 102*a*, 102*b*, but in other configurations may extend along the length or be differently configured (e.g., diagonally), where the number and configuration of the ribs 126*a*, 126*b* may depend on the dimensions, material, and configuration of the walls 102*a*, 102*b*, 102*c*, 102*d* and storage cavity 104.

The storage container 100 may also include one or more support brackets 120*a*, 120*b* that act to support the storage container 100 on a surface or component, such as on an adjacent storage container 100. The support brackets 120*a*, 120*b* may be moveable between first and second (or retracted and extended) positions. In one example, the storage container 100 may include two support brackets 120*a*, 120*b* positioned adjacent to the sidewalls 102*a*, 102*b*, but other configurations are envisioned, e.g., a single support bracket, support brackets extending from the front and/or rear sides or the like. As such, the discussion of any particular configuration is meant as illustrative only.

The support brackets 120*a*, 120*b* may be similar to one another and, in one example, include a bracket body 127 that acts to define a support structure for the storage container 100. The bracket body 127 may be defined as a generally rectangular shaped element and may include one or more stops 128 at a first or interior end. For example, the bracket body 127 may include a stop 128 on each side at the edge or near the first end of the body 127. The stops 128 may be defined as prongs or tangs that may be defined by a cutout or recess within the bracket body 127. The stops 128 act to define an increased width for the bracket body 127 to limit a movement, e.g., horizontal movement, of the bracket body 127. In one example, the stops 128 may be defined as flexible tabs, such as to allow installation of the bracket body 127.

Additionally, one or more ribs 130 may be defined on another end of the bracket body 127, such as a bottom surface of the bracket body 127. The ribs 130 may include coupling features 132 on an exterior or second end thereof. The coupling features 132 may be defined as grooves or recesses and configured to engage another element, such as the top rim 106, of an adjacent storage container 100 (see, FIGS. 7A and 7B). The ribs 130 may be used to reduce a weight of the support brackets 120*a*, 120*b*, while still providing sufficient strength and rigidity to support a weight of the storage container 100. However in other embodiments, the ribs 130 may be omitted and the coupling features 132 may be defined directly on the bracket body 127. The ribs 130, when included, may also define gripping areas, e.g., spaces between adjacent ribs 130, that assist a user in gripping the bracket body 127 to extend, retract, or otherwise manipulate the support brackets 120*a*, 120*b*.

With continued reference to FIGS. 3A and 3B, the storage container 100 may also include guide walls 138*a*, 138*b* that may be positioned adjacent to the support brackets 120*a*, 120*b*. The guide walls 138*a*, 138*b* may extend along a portion of a length of the bracket body 127 and optionally may include an overhang or lip, such that both lateral and vertical movement of the support bracket 120*a*, 120*b* may be constrained by the guide walls 138*a*, 138*b*. In one embodiment, there may be two guide walls 138*a*, 138*b* along adjacent sides of the bracket body 127, but in other configurations, fewer or more guide walls 138*a*, 138*b* may be included.

With reference to FIGS. 3A and 3B, to assemble the storage container 100, the support brackets 120*a*, 120*b* may be coupled to the bottom wall 114. For example, the bracket body 127 may be positioned between and coupled to the guide walls 138*a*, 138*b*. More specifically, the stops 128 may be flexed or deformed inwards towards a center of the bracket body 127 and the bracket body 127 may be aligned between the guide walls 138*a*, 138*b* and forced towards a center of the bottom wall 114. As the bracket body 127 is moved past the terminal end of the guide walls 138*a*, 138*b*, the stops 128 are no longer compressed against the guide walls 138*a*, 138*b* and spring outwards, defining a limit on the lateral movement of the bracket body 127. Further, the overhang on the guide walls 138*a*, 138*b* helps to define a limit on the vertical movement of the bracket body 126. In this manner, the bracket body 126 is coupled to the bottom wall 114, without requiring separate fasteners or adhesive, which can increase complexity and price of assembly.

With reference to FIGS. 1A-3B, in a first configuration, the support brackets 120*a*, 120*b* may be retracted and sit within a perimeter of the bottom edge 116 of the storage container 100. Further, as shown in FIG. 3A, the support brackets 120*a*, 120*b* may be positioned above a terminal edge or bottom surface of the bottom edge 116. For example, the support brackets 120*a*, 120*b* may have a thickness that is less than a thickness of the bottom edge 116, e.g., so as to not drag against a support surface or the like when the storage container 100 is positioned on a flat surface and supported by the bottom edge 116 rather than the support brackets 120*a*, 120*b*. Additionally, as shown in FIGS. 1A and 1B, the outer end 118 of the support brackets 120*a*, 120*b* may be configured to be aligned with the outer surface of the bottom edge 116 such that in the first position the support brackets 120*a*, 120*b* may define the appearance of a continuous uninterrupted surface along the bottom edge 116, which may create an appealing aesthetic for the storage container 100. Further, such positioning helps to ensure that the support brackets 120*a*, 120*b* do not interfere with operation of the storage container 100 or the like. In this position, the support brackets 120*a*, 120*b* may be inset within an outer perimeter of the storage container 100, such as within the perimeter of the bottom edge 116 and/or the perimeter defined by the walls 102*a*, 102*b*, 102*c*, 102*d*.

Figure 4:
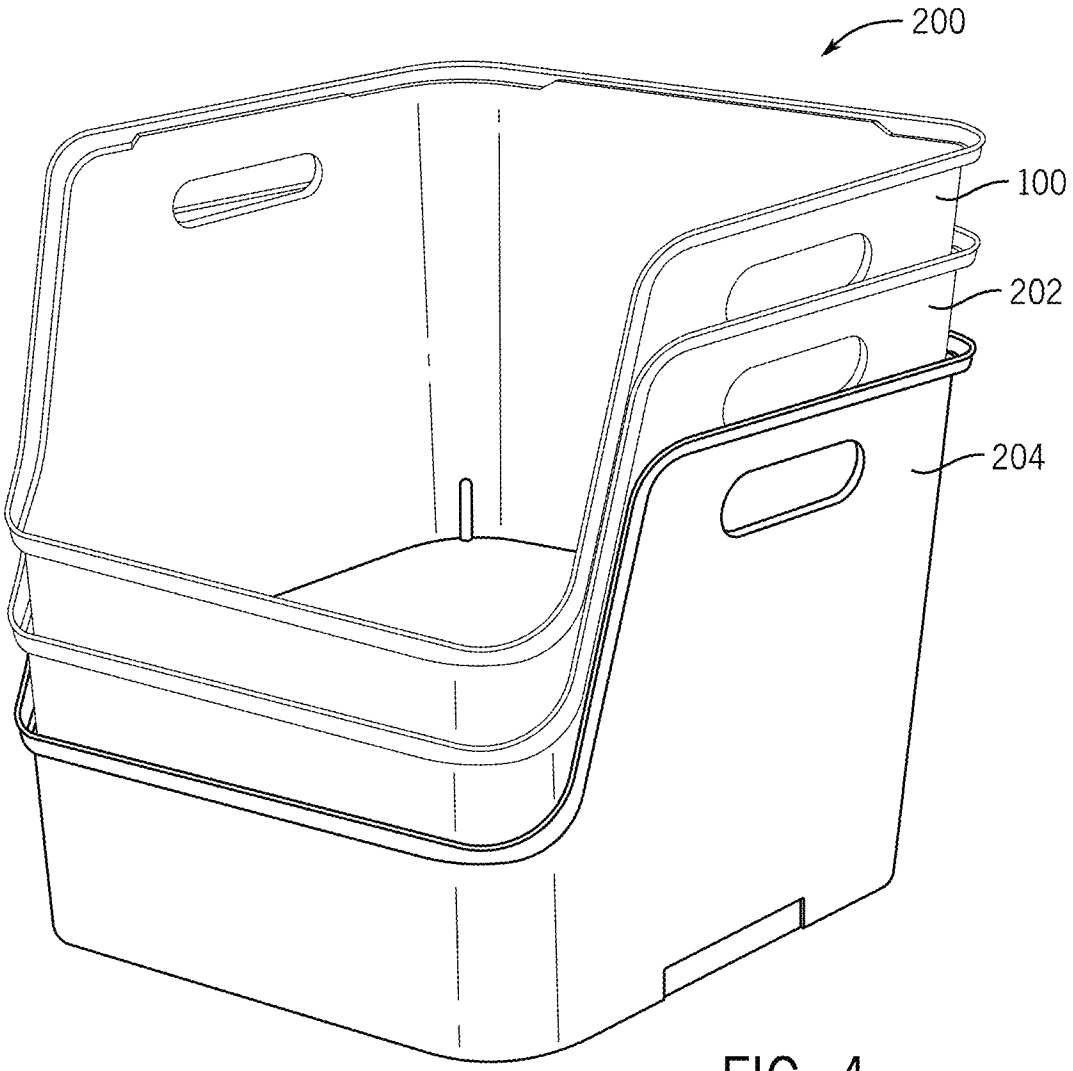
FIG. 4 is a front isometric view of a system of nested storage containers.

With reference to FIG. 4, with the support brackets 120*a*, 120*b* in the retracted position, the storage container 100 may be stacked in a first configuration with other storage containers 202, 204. More specifically, the storage container 100 may be stacked in a nested or partially nested configuration, where the top storage container 100 is seated within the storage cavity 104 of an adjacent and lower storage container 202. This may be repeated for multiple storage containers, e.g., a second storage container 202 receiving the first storage container 100 may be nested within a third or bottom storage container 204. In this configuration, the system of storage containers 100, 202, 204 may have a reduced volume as compared to an expanded configuration (see FIG. 6). This may allow multiple storage containers 100, 202, 204 to be shipped, stored, and/or displayed such as for sale by occupying a reduced volume.

Figure 5A:
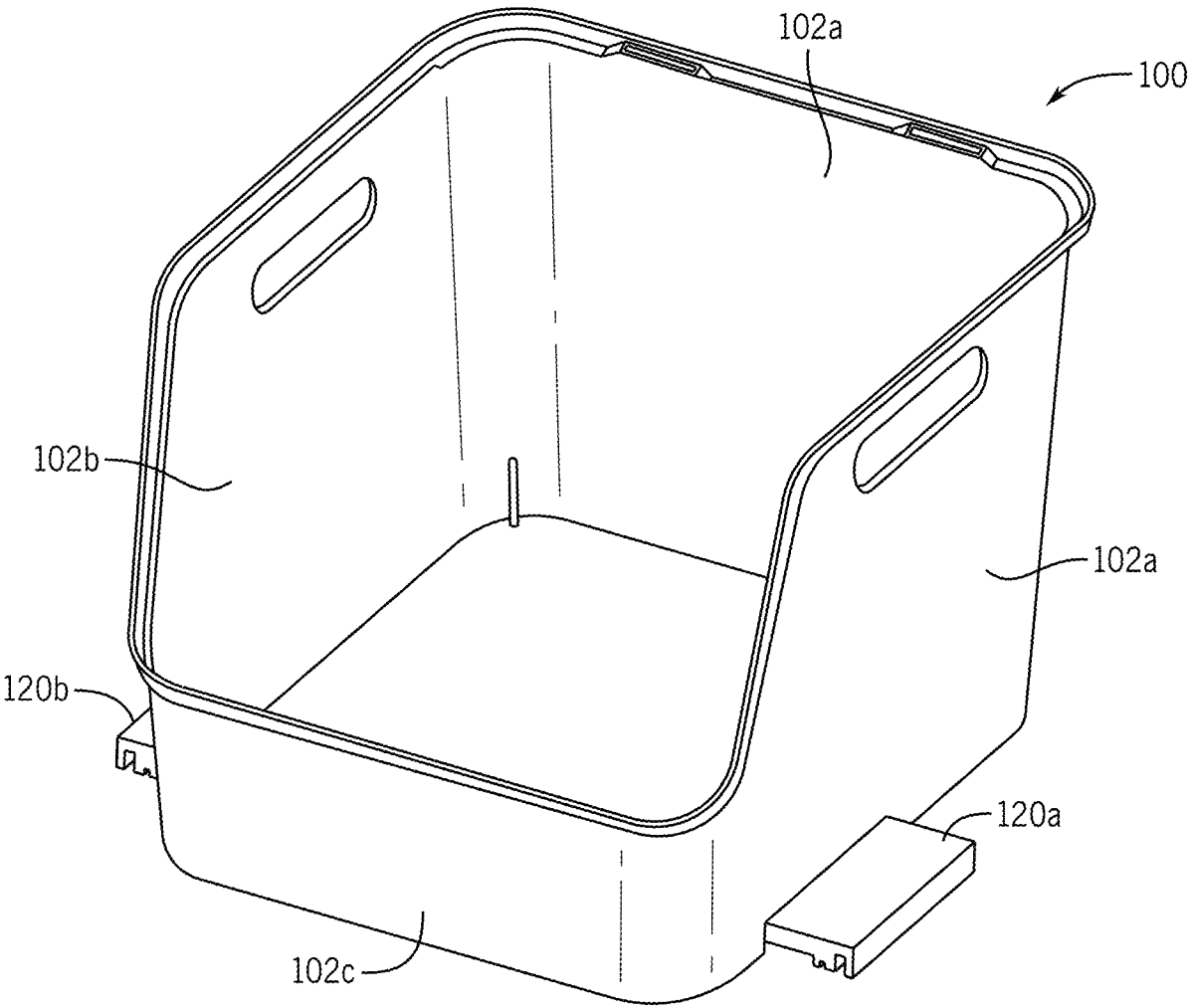
FIG. 5A is a front isometric view of the storage container with a support bracket extended into a deployed position.
Figure 5B:
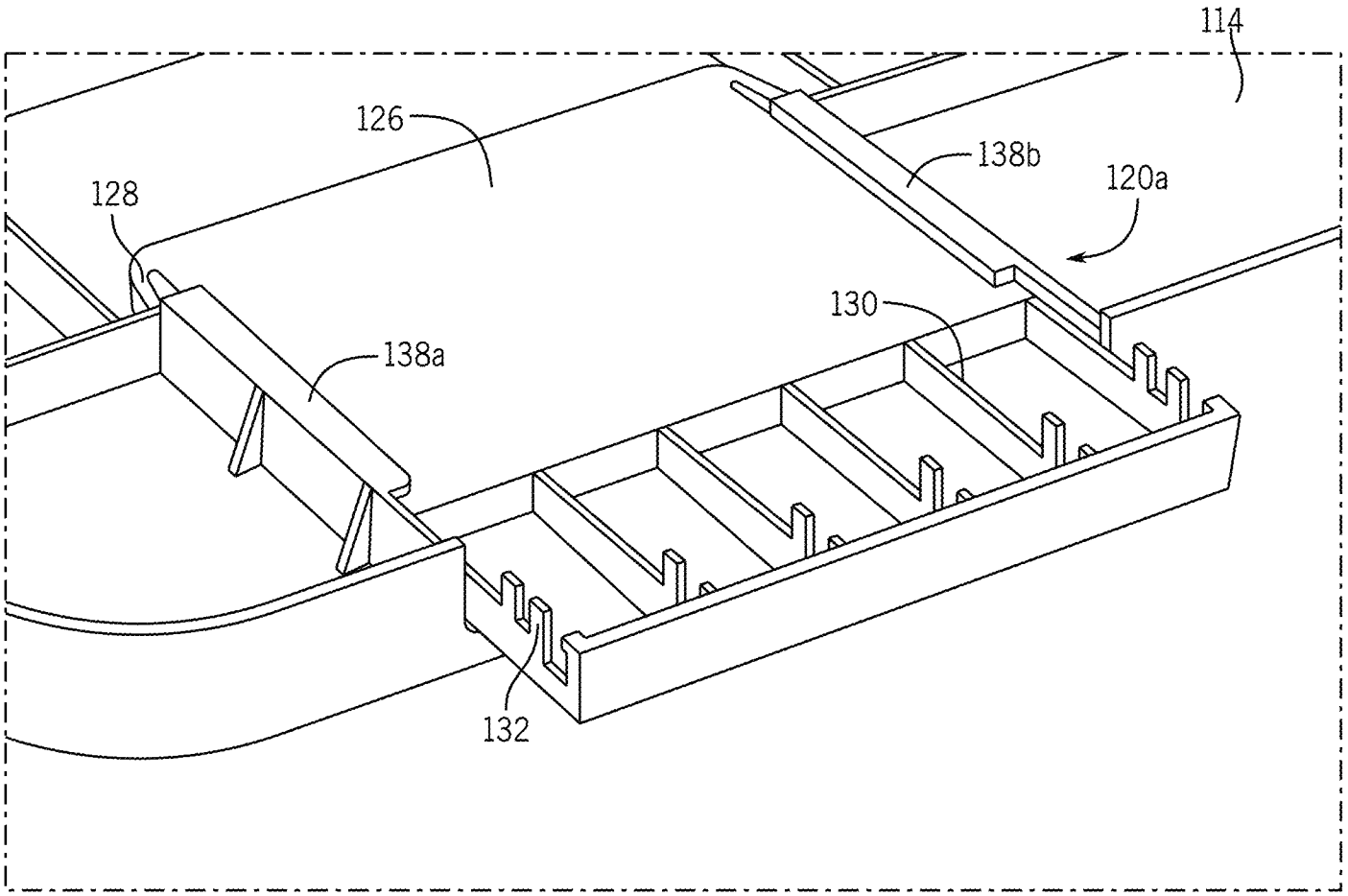
FIG. 5B is an enlarged bottom isometric view of the storage container of FIG. 5A.

FIGS. 5A and 5B illustrate various views of the storage container 100 with the support brackets 120*a*, 120*b* positioned in a deployed or extended position. With reference to FIGS. 5A and 5B, to transition the support brackets 120*a*, 120*b* into the second position, a user may grip the bracket body 127, such as by positioning one or more fingers within gaps defined by the ribs 130 and slide the bracket body 127 laterally outwards, e.g., away from a center of the bottom wall 114. As the bracket body 127 slides or moves, the guide walls 138*a*, 138*b* help to constrain the movement and ensure that the bracket body 127 does not move vertically and stays within the defined track, e.g., area between the guide walls 138*a*, 138*b*. As the first or interior end of the bracket body 127 is moved to the terminal edge of the guide walls 138*a*, 138*b*, the stops 128 engage against the ends of the guide walls 138*a*, 138*b*, and the stops 128 prevent further movement of the bracket body 127 outwards in the first direction. In the extended position, a top surface of the bracket body 127 may be exposed and extend past the perimeter of the bottom edge 116, exposing the coupling feature 132 and ribs 130 on the bottom side of the bracket body 127. Such exposure and positioning allows the support brackets 120*a*, 120*b* to be easily coupled to an adjacent storage container 100 or other element.

Figure 6:
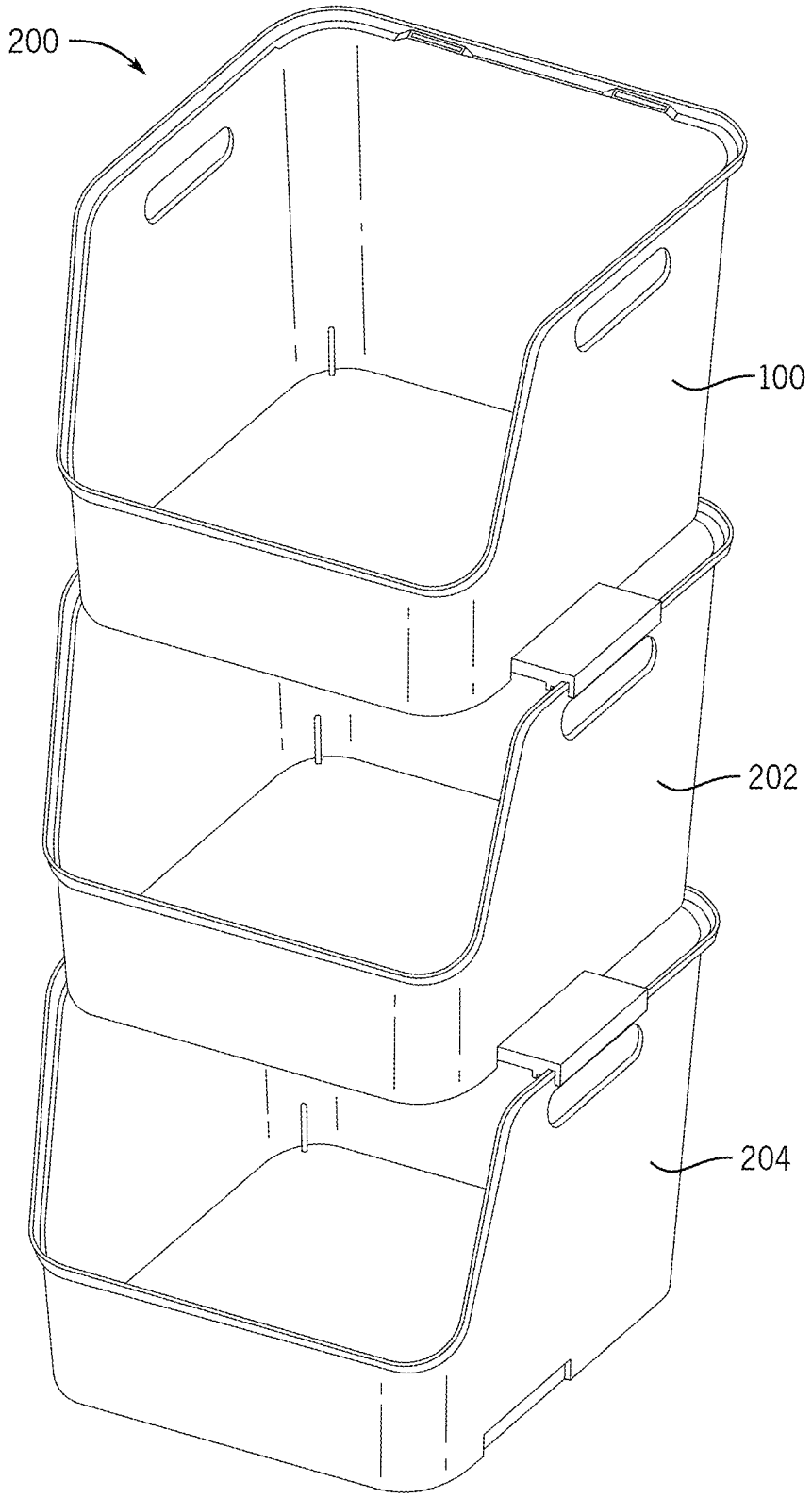
FIG. 6 is a front isometric view of a system of stacked storage containers.
Figure 7A:
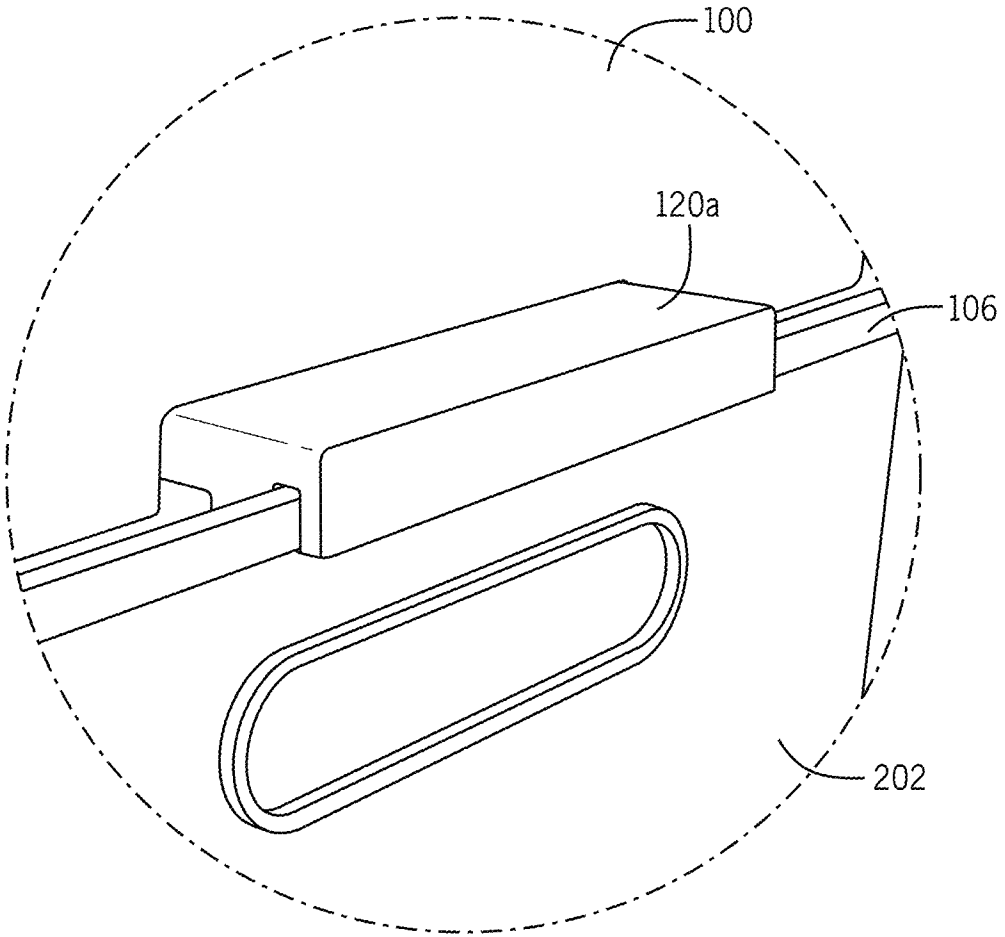
FIG. 7A is an enlarged view of the system of stacked storage containers.
Figure 7B:
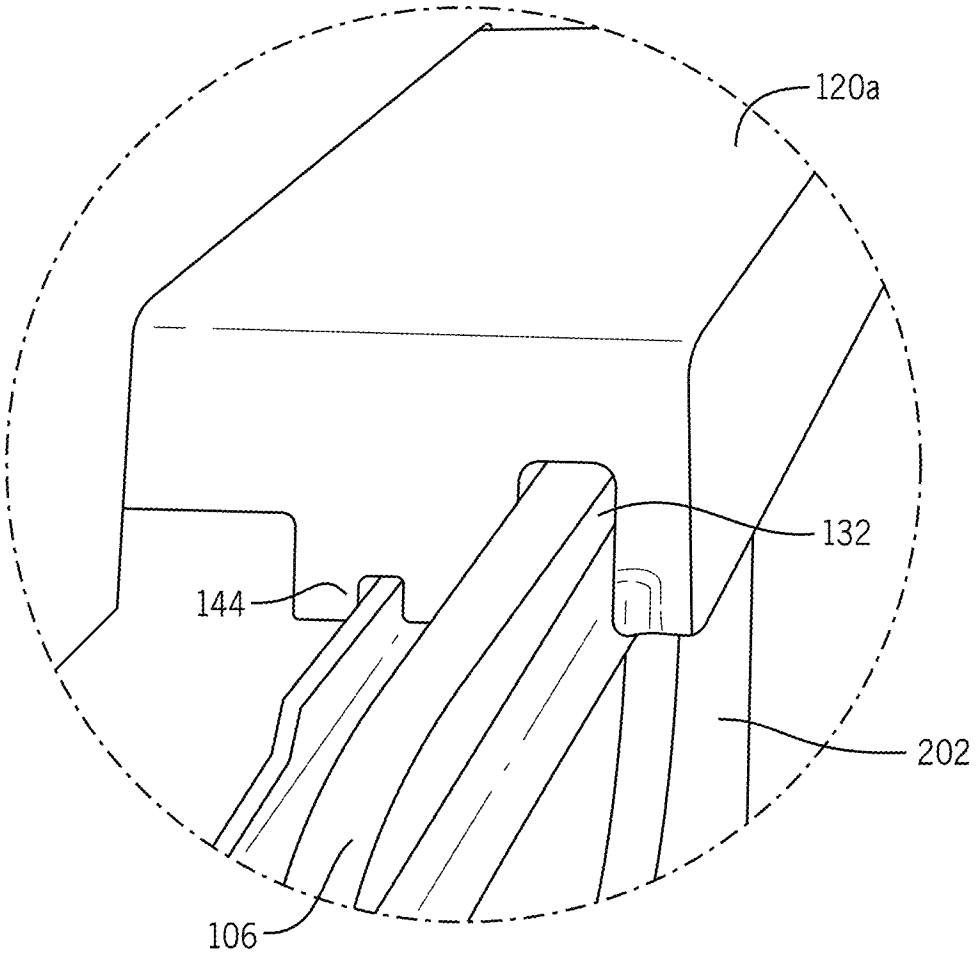
FIG. 7B is another enlarged view of the system of stacked storage containers.
Figure 8:
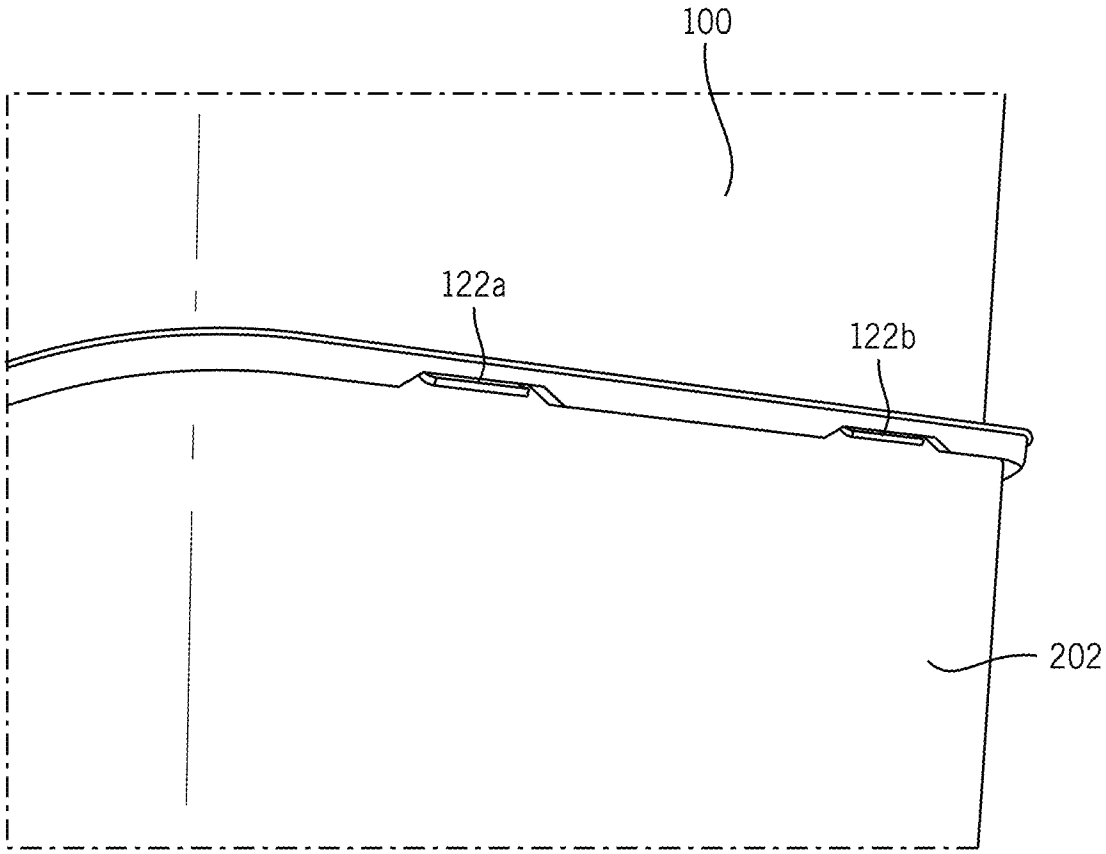
FIG. 8 is another enlarged view of the system of stacked storage containers.

FIGS. 6-8 illustrate various views of a system 200 of stacked storage containers by using the support brackets 120*a*, 120*b*. With reference to FIG. 6, with the support brackets 120*a*, 120*b* in the deployed position, the storage container 100 may be stacked on top of another adjacent storage container 202 and the second storage container 202 may be stacked on top of a third storage container 204. The support brackets 120*a*, 120*d* extend at least a width of the bottom edge 116 and couple to the top rim 106 of the adjacent storage container 100. This allows the top storage container 100, 202 to be positioned so as to not substantially interfere with the storage cavity 104 of the bottom or adjacent storage container 202, 204. Further, the various securing and coupling features of the storage containers 100 help to ensure that the system 200 is rigid and secured, e.g., help to reduce the likelihood that the stacked containers 100, 202, 204 fall over, tip, or collapse.

More specifically, with reference to FIGS. 7A and 7B, which illustrate enlarged views of the support brackets 120*a*, 120*b* coupled to the top rim 106 of adjacent storage container 202, the coupling feature 132 receives the top rim 106 therein, and optionally a secondary coupling feature 144 receives another rail or portion of the top rim 106. The coupling features 132, 144 help to secure the support bracket 120*a* in place and prevent accidental decoupling of the storage container 100 from the second storage container 202.

Further, with reference to FIG. 8, in some examples, the securing elements 122*a*, 122*b* formed on the back wall 102*d* may be used to define an auxiliary anchor between the storage containers 100, 202, 204. For example, the securing elements 122*a*, 122*b* may be received within securing apertures 121*a*, 121*b* in the adjacent or second storage container 202. This additional or auxiliary securing point helps to reduce motion between the storage containers in another direction, different from the support brackets 120*a*, 120*b*.

With the dual anchors, e.g., support brackets 120*a*, 120*b* and the securing elements 122*a*, 122*b*, the stacked storage containers 100, 202, 204 may be relatively fixed to one another and rigid, e.g., interlocked together, helping to support the system and prevent accidental decoupling of the storage containers.

FIG. 9 is an enlarged view of a pattern 900 for the storage container 100. For example, at least a portion of one or more of walls 102*a*, 102*b*, 102*c*, 102*d* of the storage container 100 may include the pattern 900 to reduce the weight of the storage container, to provide strength and/or rigidity of the storage container 100, or the like. The pattern 900 can simulate the appearance of a woven object, such as a basket. The pattern 900 can comprise a regular or irregular arrangement of raised and/or lowered surfaces, such as ridges. The pattern 900 can be arranged or oriented in various ways, such as parallel or perpendicular to one or more edges of the walls 102*a*, 102*b*, 102*c*, 102*d* and/or diagonally at various angles. In some implementations, the pattern 900 can additionally or alternatively comprise one or more apertures of any shape, which can be similarly arranged or oriented. For example, the one or more apertures can be oriented to complement an arrangement of the raised and/or lowered surfaces, such as to provide spaces between ridges, which can advantageously reduce a weight of the storage container 100 without materially reducing strength and/or rigidity. More specifically, FIGS. 10A-17 illustrate various views of the storage container of FIG. 1A including a weave feature formed as part or a portion of one or more walls, e.g., the side walls and rear walls.

It should be noted that while the various examples are described with reference to storage containers or systems, they may also be applicable other devices, such as, but not limited to, shelving, soft goods, or the like. As such, the discussion on any particular implementation is meant as illustrative only.

The above specification, examples and data provide a complete description of the structure and use of exemplary embodiments of as defined in the claims. Although various embodiments have been described above with a certain degree of particularity, or with reference to one or more individual embodiments, other embodiments using different combinations of elements and structures disclosed herein are contemplated, as other iterations can be determined through ordinary skill based upon the teachings of the present disclosure. It is intended that all matter contained in the above description and shown in the accompanying drawings shall be interpreted as illustrative only of particular embodiments and not limiting. Changes in detail or structure may be made without departing from the basic elements as defined in the following claims.

What is claimed is:

1. A storage container comprising:

a plurality of sidewalls;

a bottom wall operably coupled to the plurality of sidewalls, together defining a storage cavity;

at least one support bracket coupled to the bottom wall, movable between a first position wherein an outer surface of at least one support bracket is flush with a perimeter of the bottom wall, and a second position wherein the outer surface of the at least one support bracket extends beyond the perimeter; and a plurality of guide walls extending parallel to one another and formed adjacent to the at least one support bracket that guide the movement of the at least one support bracket between the first position and the second position.

2. The storage container of claim 1, wherein the at least one support bracket includes a coupling feature configured to engage a portion of another storage container.

3. The storage container of claim 2, wherein the at least one support bracket comprises:

a bracket body including:

a first portion, including the outer surface, that extends beyond the perimeter when the at least one support bracket is in the second position, and a second portion that does not extend beyond the perimeter when the at least one support bracket is in the second position; and the coupling feature includes a hook portion disposed at an end of the first portion and extending from the first portion toward the second portion.

4. The storage container of claim 2, wherein the portion of the another storage container comprises a top rim thereof.

5. The storage container of claim 1, wherein the at least one support bracket comprises a stop portion that defines a length of movement from the first position to the second position.

6. The storage container of claim 1, wherein the plurality of sidewalls comprises a front wall, a rear wall, a left sidewall and a right sidewall, wherein the front wall is of a lower height than the rear wall and the left and right sidewalls each include respective angled transition portions connecting to the front wall.

7. The storage container of claim 1, wherein the guide walls each include a respective lip.

8. The storage container of claim 7, wherein the respective lips extend at least partially over the at least one support bracket.

9. The storage container of claim 8, wherein the respective lips constrain at least one of a lateral or a vertical movement of the at least one support bracket between the first position and the second position.

10. The storage container of claim 1, further comprising a bottom edge defining a support surface for the container, wherein the at least one support bracket is received within a bracket cutout of the bottom edge when in the first position.

11. The storage container of claim 1, wherein the at least one support bracket includes a plurality of ribs extending from a bottom surface thereof.

12. A storage system comprising:

a first storage container including:

a plurality of sidewalls;

a bottom wall operably coupled to the plurality of sidewalls;

a support bracket movable between a retracted position and a deployed position, wherein at least a portion of the support bracket is flush with a perimeter of the bottom wall in the retracted position and at least a portion of the support bracket extends beyond the perimeter in the deployed position;

a plurality of guide walls extending parallel to one another and formed adjacent to the support bracket that guide the movement of the support bracket between the retracted position and the deployed position;

a second storage container defining a storage cavity, wherein:

when the support bracket is in the retracted position, the first storage container is nestable within the storage cavity of the second storage container; and when the support bracket is in the deployed position, the first storage container is stackable on the second storage container, positioning the first storage container above the storage cavity, wherein the support bracket engages a portion of the second storage container.

13. The storage system of claim 12, wherein the support bracket includes a coupling feature that engages the portion of the second storage container.

14. The storage system of claim 13, wherein the support bracket comprises:

a bracket body including:

a first portion that extends beyond the perimeter when the support bracket is in the deployed position, and a second portion that does not extend beyond the perimeter when the support bracket is in the deployed position; and the coupling feature includes a hook portion disposed at an end of the first portion and extending from the first portion toward the second portion.

15. The storage system of claim 12, wherein the portion of the second storage container comprises a top rim thereof.

16. The storage system of claim 12, wherein the support bracket comprises a stop portion that defines a length of movement from the retracted position to the deployed position.

17. The storage system of claim 12, wherein the plurality of sidewalls comprises a front wall, a rear wall, a left sidewall and a right sidewall, wherein the front wall is of a lower height than the rear wall and the left and right sidewalls each include respective angled transition portions connecting to the front wall.

18. The storage system of claim 12, wherein the guide walls each include a respective lip, the respective lips extend at least partially over the support bracket and constrain at least one of a lateral or a vertical movement of the support bracket between the retracted position and the deployed position.

19. The storage system of claim 12, wherein the support bracket includes a plurality of ribs extending from a bottom surface thereof.

20. A stackable storage container comprising:

a front wall, a rear wall, a left sidewall and a right sidewall, wherein the front wall is of a lower height than the rear wall, and the left and right sidewalls each include respective angled transition portions connecting to the front wall;

a support bracket coupled to the bottom wall, movable between a first position where an outer surface of the support bracket is flush with a perimeter of the bottom wall, and a second position where the outer surface extends beyond the perimeter;

a plurality of guide walls extending parallel to one another and formed adjacent to the support bracket that guide the movement of the support bracket between the first position and the second position, wherein the guide walls each include a respective lip, the respective lips extend at least partially over the support bracket and constrain at least one of a lateral or a vertical movement of the support bracket between the first position and the second position.

* * * * *